US008573992B2

(12) United States Patent
Roberts, Jr. et al.

(10) Patent No.: US 8,573,992 B2
(45) Date of Patent: Nov. 5, 2013

(54) CONNECTOR SYSTEM AND METHOD

(75) Inventors: Howard H. Roberts, Jr., Austin, TX (US); James Allen Andrews, Austin, TX (US); Chris D. Eckhoff P. E., Austin, TX (US); Randal A. Lee, Marble Falls, TX (US)

(73) Assignee: Little Engine Labs, LLC

( * ) Notice: Subject to any disclaimer, the term of this patent is extended or adjusted under 35 U.S.C. 154(b) by 22 days.

(21) Appl. No.: 13/348,618

(22) Filed: Jan. 11, 2012

(65) Prior Publication Data

US 2012/0190226 A1 Jul. 26, 2012

Related U.S. Application Data

(60) Provisional application No. 61/431,565, filed on Jan. 11, 2011.

(51) Int. Cl.
*H01R 13/703* (2006.01)

(52) U.S. Cl.
USPC ..... 439/188; 200/51.09

(58) Field of Classification Search
USPC ..... 200/51.05, 51.07, 51.09, 51 R, 51.1, 200/51.12; 439/188
See application file for complete search history.

(56) References Cited

U.S. PATENT DOCUMENTS

| | | | | |
|---|---|---|---|---|
| 4,014,359 | A * | 3/1977 | Sanner | 137/78.2 |
| 5,484,298 | A | 1/1996 | Flum et al. | |
| 5,791,441 | A * | 8/1998 | Matos et al. | 188/1.11 L |
| 5,857,861 | A * | 1/1999 | Silliman | 439/171 |
| 6,587,056 | B1 * | 7/2003 | Fraser et al. | 340/945 |
| 7,758,365 | B2 * | 7/2010 | Purchon | 439/188 |

* cited by examiner

*Primary Examiner* — Gary F. Paumen
(74) *Attorney, Agent, or Firm* — The Law Firm of H. Dale Langley, Jr., P.C

(57) ABSTRACT

An electrical connector for connecting to ground and first and second signal lines includes a ground contact, a first signal contact, a second signal contact, and a switch connected to the first signal contact and the ground contact. The switch is biased "on" until after the first signal contact is connected to the first signal line, the ground contact is connected to the ground, and the second signal contact is connected to the second signal line. The switch, during connection of the connector to ground and first and second signal lines, is thereby automatically triggered to "off" during connection of the connector. If the first and second signal lines are differential signals, the switch, instead, electrically connects and disconnects the first signal contact to the second signal contact.

13 Claims, 27 Drawing Sheets

Connection Sequence, XLR

| | Normal disconnected state. | Signal connections changing, female connector shorted. | Signal connections normal, female short changing. | Normal connected state. |
|---|---|---|---|---|
| Insertion | Female shorted, no signals connected. | All signals making contact, female shorted: transient noise masked. | All signals connected, female controlled short breaking, all signals connected. | Normal connection. |
| Retraction | Female shorted, no signals connected. | All signals breaking contact, female shorted: transient noise masked. | All signals connected, female controlled short making, all signals connected. | Normal connection. |

FIG. 4

Test Data - Female 1/4 Inch Unbalanced

*The normal hum and popping that occurs during change in connection of standard analog audio connectors (left) is not present in the experiment testing the invention (right).*

Drill Hole In Case For Switch Actuator
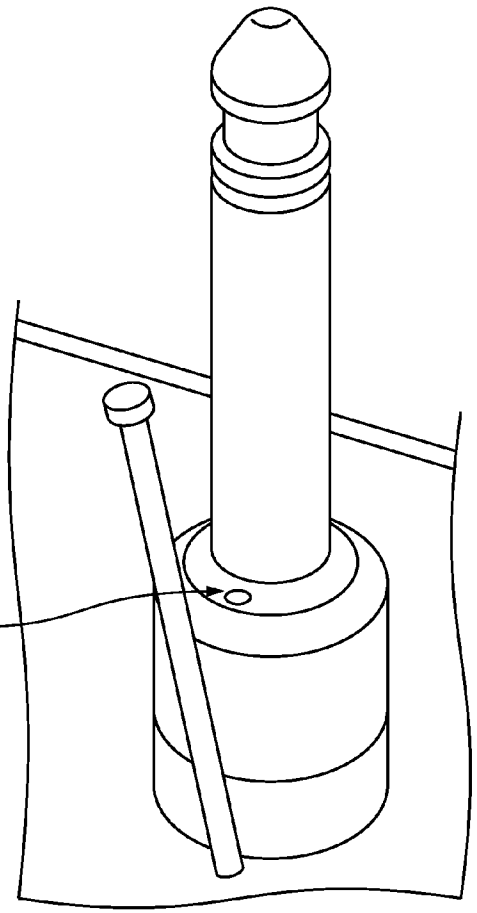
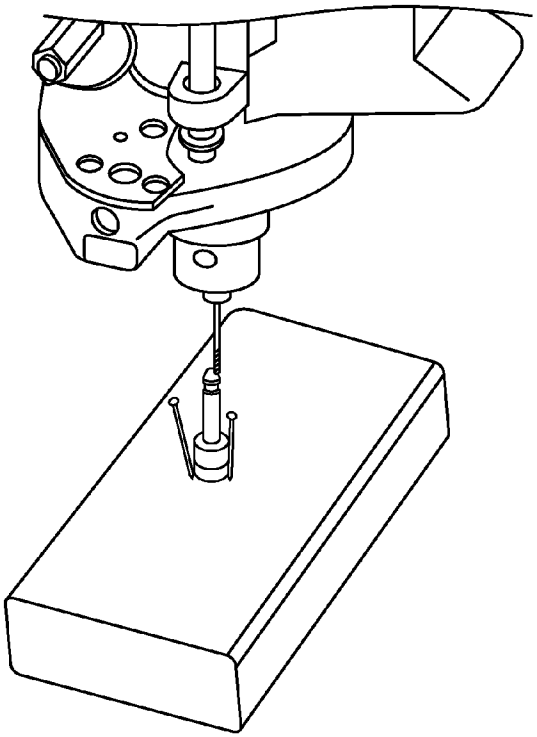
*A jig made form a piece of 2x4 is constructed to hold the male jack while drilling. A 1/6" hole is drilled in the flange at the top of the jack case and parallel to the jack sleeve. This hole will be fitted with a spring and push rod to actuate the switch.*
FIG. 12C

Insert Push Rod, Secure, Tension

The push rod is inserted and secured to the contact switch using a bead of epoxy glue. Once the glue sets, the spring is tensioned to make contact in the switch (shorted between signal and ground).

Secure Tension, Clip Push Rod

*The spring is tensioned just enough to make reliable contact and tested for repeatability. The tension is then fixed to maintain the appropriate stretch using an epoxy bead. The spring is trimmed after the epoxy sets. The push rod is tested for travel and extension and then trimmed to the appropriate length.*

Reassemble The Jack

CONNECTOR SYSTEM AND METHOD

CROSS-REFERENCE TO RELATED APPLICATIONS

The present application is a conversion and has benefit of priority of U.S. Provisional Patent Application No. 61/431,565, titled "Analog Audio Connector System and Method", filed Jan. 11, 2011, which application is co-pending and has at least one same inventor of the present application and is herein incorporated by this reference.

TECHNICAL FIELD

The present disclosure generally relates to connectors, such as for audio connections, and more particularly relates to connectors for analog connections for avoiding pop, noise, or other transient spike burst on connection or disconnection to a source, such as an amplifier or other analog equipment.

BACKGROUND

Most analog audio connectors, both balanced and unbalanced, suffer a common problem. When connection is either made or broken between a source and a receiver, an unpleasant and potentially system damaging noise transient is generated on the connection path. This noise transient sounds like a pop or short duration burst of noise. The pop or noise burst is not only a very unpleasant audible sound, it can damage an attached amplification system amplifying the signal when the transient noise occurs.

Similar concerns of transient spikes or bursts are experienced in connecting many other analog source and receiver devices, including mission critical systems. These spikes or bursts can damage equipment and at least momentarily affect signals. The typical connector has provided an instantaneous physical and electrical make or break of connection between devices when the connector is physically connected or disconnected, respectively, to a corresponding mate connector. This instantaneous make or break of connection of physical and electrical connection creates transient noise, spikes, or bursts of signal.

A balanced system 10 of FIGS. 1 and 3 illustrates one example, from among others, of an analog source 102 electrically connected, via typical XLR connectors 108, 114, 118, 120, to an analog receiver 104. The source 102 includes, as an example, a microphone 106 (or other source device) and a male connector 108. The receiver 110 includes, for example, an amplifier 112 (or other receiver device) and a female connector 114. The source 102 is electrically connected to the receiver 110 by a cable 116. The cable 116 terminates at ends, respectively, with a balanced female connector 118 and a balanced male connector 120. In operation, the balanced female connector 118 of the cable 116 connects to the male connector 108 of the source 102 and the balanced male connector 120 of the cable 116 connects to the female connector 114 of the receiver 110. When the cable 116 is connected/disconnected to the source 102 or the receiver 110, the operation of physically connecting/disconnecting the cable 116 causes a transient noise, spike or burst to occur. This can cause a pop or noise burst with conventional XLR type connectors in such a balanced system.

Similarly, in an unbalanced system 20 of FIG. 2, as one example, from among others, an analog source 202 is electrically connected, via typical TRS (tip, ring, sleeve) connectors 208, 214, 218, 220, to an analog receiver 204. The source 202 is, as an example, a musical instrument 206 having a female connector 208. The receiver 204 is, for example, an audio amplifier 212 having a female connector 214. The source 202 is electrically connected to the receiver 210 by a cable 216, having ends, respectively, terminating with an unbalanced male connector 218 and an unbalanced male connector 220. In use, the unbalanced female connector 218 connects to the male connector 208 and the unbalanced male connector 220 connects to the female connector 214. When the cable 216 is connected/disconnected to either of the source 202 or the receiver 210, the operation of physically connecting/disconnecting the cable 216 causes a transient noise, spike or burst to occur, causing a pop or noise burst with conventional TRS type connectors that may be amplified at the receiver 204.

It would, therefore, be advantageous to provide connector systems and methods for reducing or substantially eliminating transient noise, spikes or bursts when connecting and disconnecting connectors. It would also be advantageous to provide such solutions that are widely compatible and desirable in design and operation, at reasonable cost and economy of size and adaptability.

SUMMARY

An analog connector, such as an audio connector, provides a low resistance short between two signal carrying lines of a cable or circuit connected to the connector. When the cable or circuit is disconnected, the short provided by the connector is present between the two signal carrying lines of the cable or circuit. During connection of the cable or circuit to the connector, the short provided by the connector is broken only after connection is made between a source and receiver (break after make). During disconnect of the cable or circuit, the short provided by the connector is reestablished before connection between the source and receiver is broken (make before break). The connector is operable for both unbalanced and balanced cable lines. In balanced lines, the short is between differential signal lines. For example, in an XLR cable, the short is between pins of opposing polarity (e.g., pins 2 and 3 or other combination as applicable according to standard or custom) or other signal carrying lines as applicable. In unbalanced lines, the short is between the single-ended signal line and the ground.

An embodiment of the invention is an electrical connector for connecting to ground and first and second signal lines. The connector includes a ground contact for connecting to ground, a first signal contact for connecting to the first signal line, a second signal contact for connecting to the second signal line and a switch connected to the first signal contact and the ground contact, the switch is biased to "on" to electrically connect the first signal contact to the ground contact until after the first signal contact is connected to the first signal line, the ground contact is connected to the ground, and the second signal contact is connected to the second signal line. The switch, during connection of the connector to ground and first and second signal lines, is thereby automatically triggered to "off" during connection of the connector, to electrically disconnect the first signal contact from the ground contact during connecting of the first signal contact to the first signal line, the ground contact to the ground, and the second signal contact to the second signal line.

In another embodiment, if the first and second signal lines are differential signals, the switch connects instead to the first signal contact and second signal contact in the connector.

Another embodiment of the invention is a circuit of an electrical connector. The circuit includes a ground contact for connecting to ground, a first signal contact for connecting to a first signal line, a second signal contact for connecting to a second signal line, and a switch connected to the first signal contact and the ground contact, operative to electrically disconnect the first signal contact and the ground after the ground contact is connected to the ground, the first signal contact is connected to the first signal line, and the second signal contact is connected to the second signal line, and operative to electrically connect the first signal contact and the ground as the first signal contact is being disengaged from the first signal line but while, at least momentarily, the first signal contact continues to remain connected to the first signal line.

In another embodiment, if the first and second signal lines are differential signals, the switch of the circuit connects instead to the first signal contact and second signal contact.

Yet another embodiment of the invention is a switch of a connector. The connector includes a ground contact, a first signal contact and a second signal contact, the connector capable of mating with a ground and first and second signal lines, for electrical connection and disconnection of the ground contact to the ground, the first signal contact to the first signal line and the second signal contact to the second signal line. The switch includes a conductor connected to the first signal contact, the conductor is biased to contact the ground contact and electrically connect the first signal contact and the ground contact. The conductor of the switch is operatively disengaged from electrical connection to the ground contact during mating of the connector, via the ground contact, the first signal contact and the second signal contact, with the ground, the first signal line and the second signal line, respectively, only after the ground contact is touching the ground, the first signal contact is touching the first signal line, and the second signal contact is touching the second signal line. The conductor of the switch is operatively engaged in electrical connection to the ground contact during de-mating of the connector, via the ground contact, the first signal contact and second signal contact, with the ground, the first signal line and the second signal line, respectively, before the ground contact is completely disengaged from touching the ground, the first signal contact is completely disengaged from touching the first signal line, and the second signal contact is completely disengaged from touching the second signal line.

In another embodiment, if the first and second signal lines are differential signals, the conductor of the switch connects instead to the first signal contact and second signal contact.

Another embodiment of the invention is a method of connecting a connector having a ground contact, a first signal contact and a second signal contact, to a ground, a first signal line and a second signal line, respectively. The method includes connecting, substantially concurrently, the ground contact to the ground, the first signal contact to the first signal line, and the second signal contact to the second signal line, and disengaging a conductor electrically connected to the first signal contact and the ground contact from electrical connection to the ground contact, after the step of connecting.

In another embodiment, if the first and second signal lines are differential signals, the step of disengaging electrically disconnects the conductor from the second signal contact, rather than the ground contact.

Yet another embodiment of the invention is a method of disconnecting a connector having a ground contact, a first signal contact and a second signal contact, from connection to a ground, a first signal line and a second signal line, respectively. The method includes engaging a conductor connected to the first signal contact to electrically connect the ground contact and the first signal contact, and disconnecting, substantially concurrently after the step of engaging, the ground contact from the ground, the first signal contact from the first signal line, and the second signal contact from the second signal line.

In another embodiment, if the first and second signal lines are differential signals, the step of engaging electrically connects the conductor to the second signal contact, rather than the ground contact.

Another embodiment of the invention is a method of manufacture of a connector. The connector has a ground contact, a first signal contact and a second signal contact. The method includes forming a switch in the first signal contact, the switch including a conductor biased to electrically connect the first signal contact to one of either the ground contact and instead, if the connector is for connection to differential signals, to the second signal contact, and providing the switch with an actuator operative to disconnect the conductor from electrical connection to the ground and, instead, the second signal contact, if applicable, only if the ground contact, the first signal contact and the second signal contact are electrically connected to a ground, a first signal line and a second signal line.

Yet another embodiment of the invention is a retrofit connector, the retrofit connector capable of connecting to another connector where the other connector is one of either an XLR connector or a TRS connector. The retrofit connector includes a housing, a pass through ground contact of the housing capable of connecting to a ground signal line and a ground contact of the other connector, a pass through first signal contact of the housing capable of connecting to a first signal line and a first signal line of the other connector, a pass through second signal contact of the housing capable of connecting to a second signal line of the other connector, and a switch contained in the housing, the switch operatively biased to electrically connect the pass through first signal contact to one of either the pass through ground contact and the pass through second signal contact. The switch is electrically disconnected from the either of the pass through ground contact and the pass through second signal contact, as applicable, during mating of the retrofit connector, via the pass through ground contact, the pass through first signal contact and the pass through second signal contact, with the ground contact, the first signal contact and the second signal line, respectively, of the other connector, only after the pass through ground contact is touching the ground contact, the pass through first signal contact is touching the first signal contact, and the pass through second signal contact is touching the second signal contact. The switch electrically connects the pass through first signal contact to either of the pass through ground contact and the pass through second signal contact, as applicable, during de-mating of the retrofit connector, via the pass through ground contact, the pass through first signal contact and pass through second signal contact, from connection to the ground contact, the first signal contact and the second signal contact, respectively, of the other connector, before the pass through ground contact is completely disengaged from touching the ground contact, the pass through first signal contact is completely disengaged from touching the first signal contact, and the pass through second signal contact is completely disengaged from touching the second signal contact.

BRIEF DESCRIPTION OF THE DRAWINGS

The present invention is illustrated by way of example and not limitation in the accompanying figures, in which like references indicate similar elements, and in which:

FIG. 4 illustrates an exemplary connection and disconnection sequence for an analog audio connector (XLR) providing a low resistance short, according to certain embodiments of the invention;

FIGS. 12A-12G illustrate another exemplary male analog audio connector (¼ Phono Jack) for providing a low resistance short for unbalanced lines, and exemplary method of manufacture thereof, according to certain embodiments of the invention;

DESCRIPTION

Disclosed are certain embodiments, with reference to the appended drawings, of a connector. The connector comprising an actuatable switch operated during physical connection or disconnection of the connector to a corresponding mate connector in an electrical circuit. The actuatable switch immediately shorts between two electrical lines or pins just prior to breaking physical connection of electrical circuits of the connector to the mate connector, and the short is broken after making physical connection of electrical circuits of the connector to the mate connector The connector, in operation, provides a low resistance short when connecting to or disconnecting from a corresponding mate connector, and prevents transient noise that would otherwise be presented during make or break of physical connection of electrical circuits of the connector to the mate connector, respectively. In certain alternatives, the connector may be manually controlled (such as by a manual switch, toggle, or other device) or otherwise controlled by other systems or devices to provide the low resistance short as and when desired just prior to break (i.e., physical disconnection between circuits of the connector and the mate connector) and just after make (i.e., physical connection between circuits of the connector and the mate connector). The connector is, for example, advantageous to analog audio connections, in both balanced and unbalanced lines, to avoid noise transient on the connection path, such as pops or short duration bursts of noise, and system damage, particularly, for example, in amplifying systems.

Figure 13:
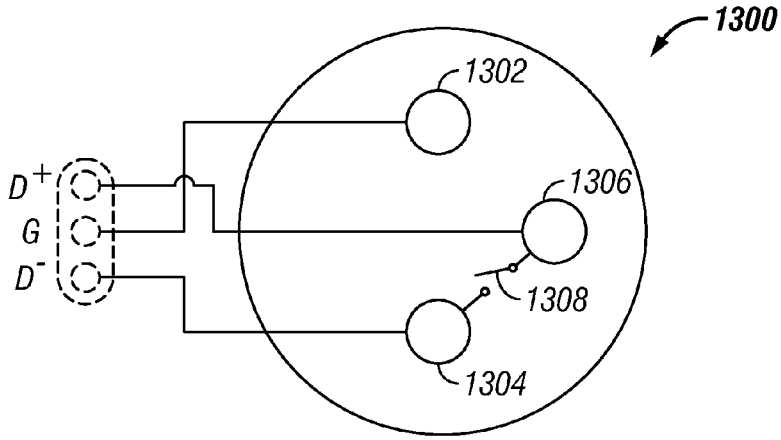
FIG. 13 illustrates a circuit of a connector, including a switch, according to certain embodiments of the invention.
Figure 14A:
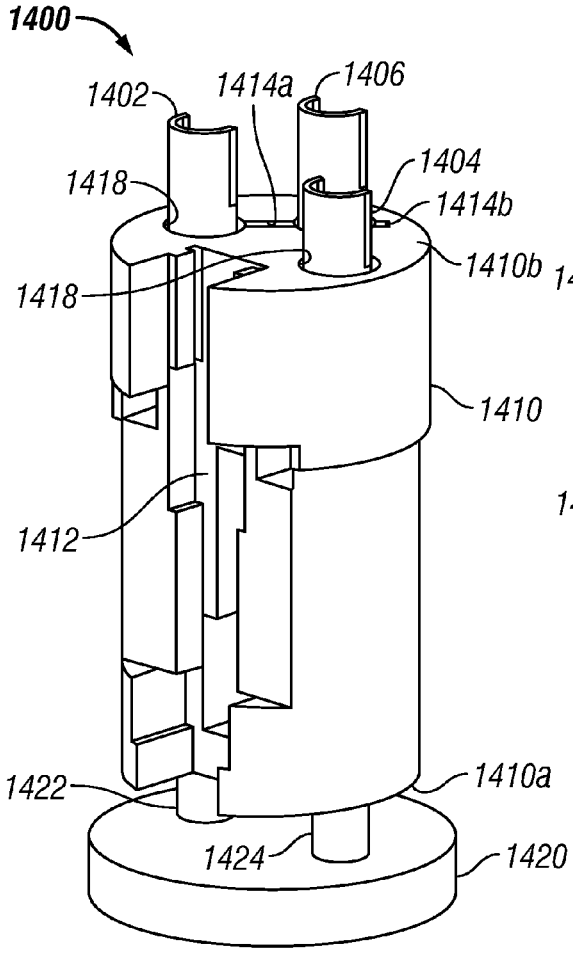
FIGS. 14A-D illustrate an exemplary female XLR connector, including a switch, engaged with a mate male connector, according to certain embodiments of the invention.
Figure 14B:
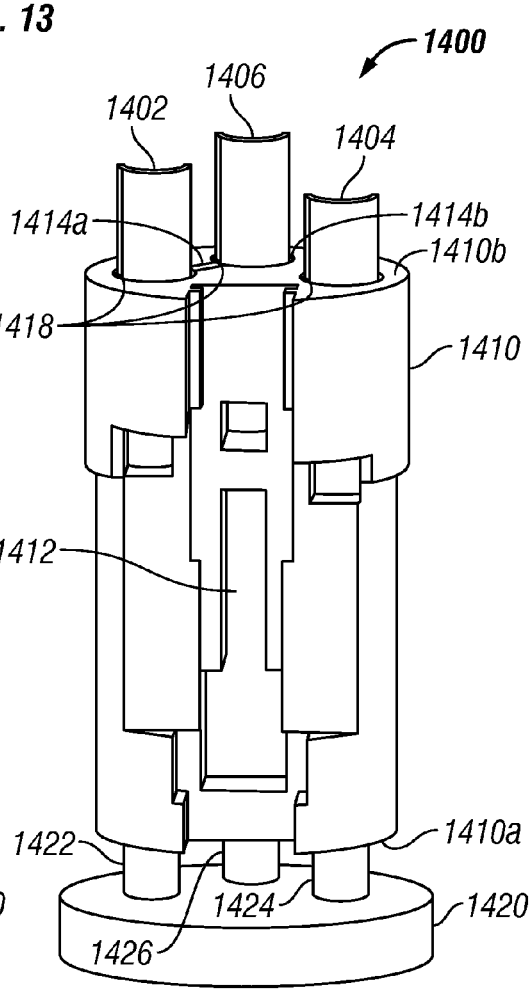
Figure 14D:
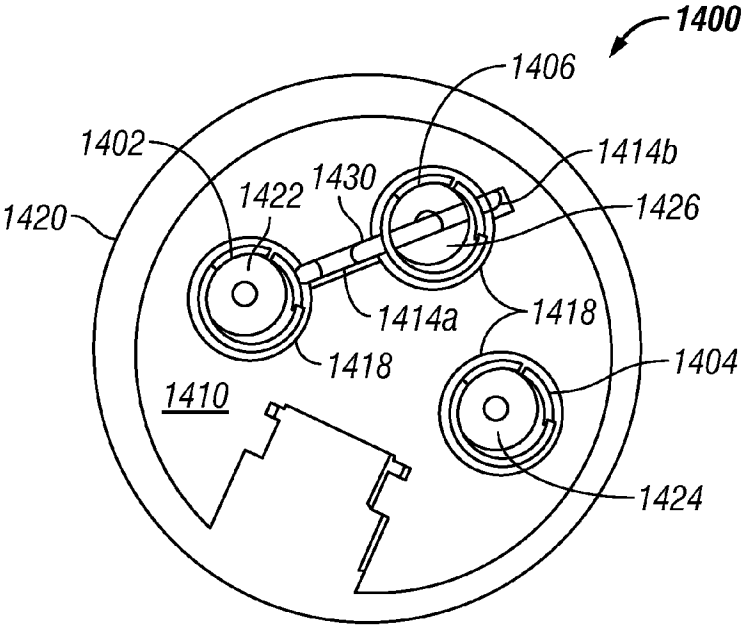
Figure 14C:
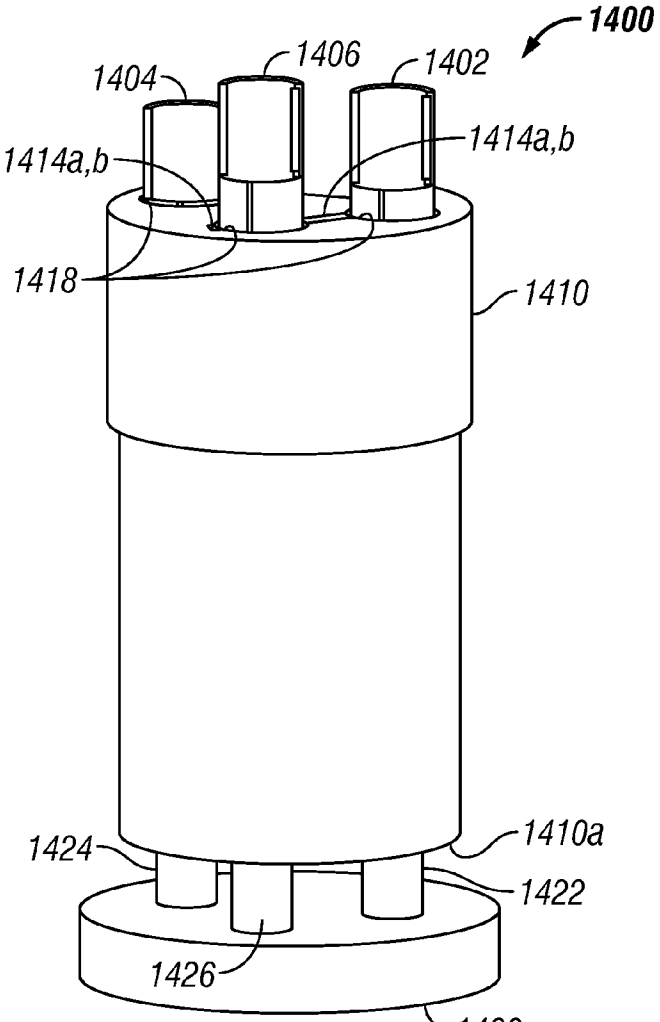

Referring to FIG. 13, a connector 1300 is connected to an input device (shown in phantom), for example, a mixer, audio processor, amplifier, pre-amp, or similar device. The connector 1300 connects to the device in typical manner, for example, by direct connection to a mated connector of the device, via a cord attached to the connector 1300 and the device, or otherwise. The device provides poles or contacts for at least ground (G), and two opposing or differential signals (D+ and D−). An example of the input device is an analog input driver circuit or device, for example, a mixer, audio processor, amplifier, pre-amp, or similar device. The connector 1300 includes a first contact 1302 (connected to ground), a second contact 1304 (connected to one output pole of the device), and a third contact 1306 (connected to the other output pole of the device). The connector also includes a switch 1308. The switch 1308 connects the second contact 1304 and the third contact 1306. An example of the switch is a single pole, single throw (SPST or "two way") switch that is positioned either "on" or "off". As will be understood, for this example of the switch 1308, when the switch 1308 is "on", connection between the second contact 1304 and the third contact 1306 is completed (or "closed") by the switch 1308, and when the switch 1308 is "off", connection between the second contact 1304 and the third contact 1306 is disconnected (or "opened") by the switch 1308. Thus, when the connector 1300 is connected via the contacts 1302, 1304, 1306 to the respective poles or differential signals of the device, the switch 1308 in "closed" position shorts contacts 1304, 1306 to the device but the switch 1308 in "open" position allows the device to connect to ground only by one contact 1302 and the other two contacts 1304, 1306 are capable of connecting to the opposing poles or signals (D+/D−) of the device (assuming, of course, completion of the circuit via an input device connected to or incorporating the three contacts 1302, 1304, 1306 of the connector 1300).

Figure 1:
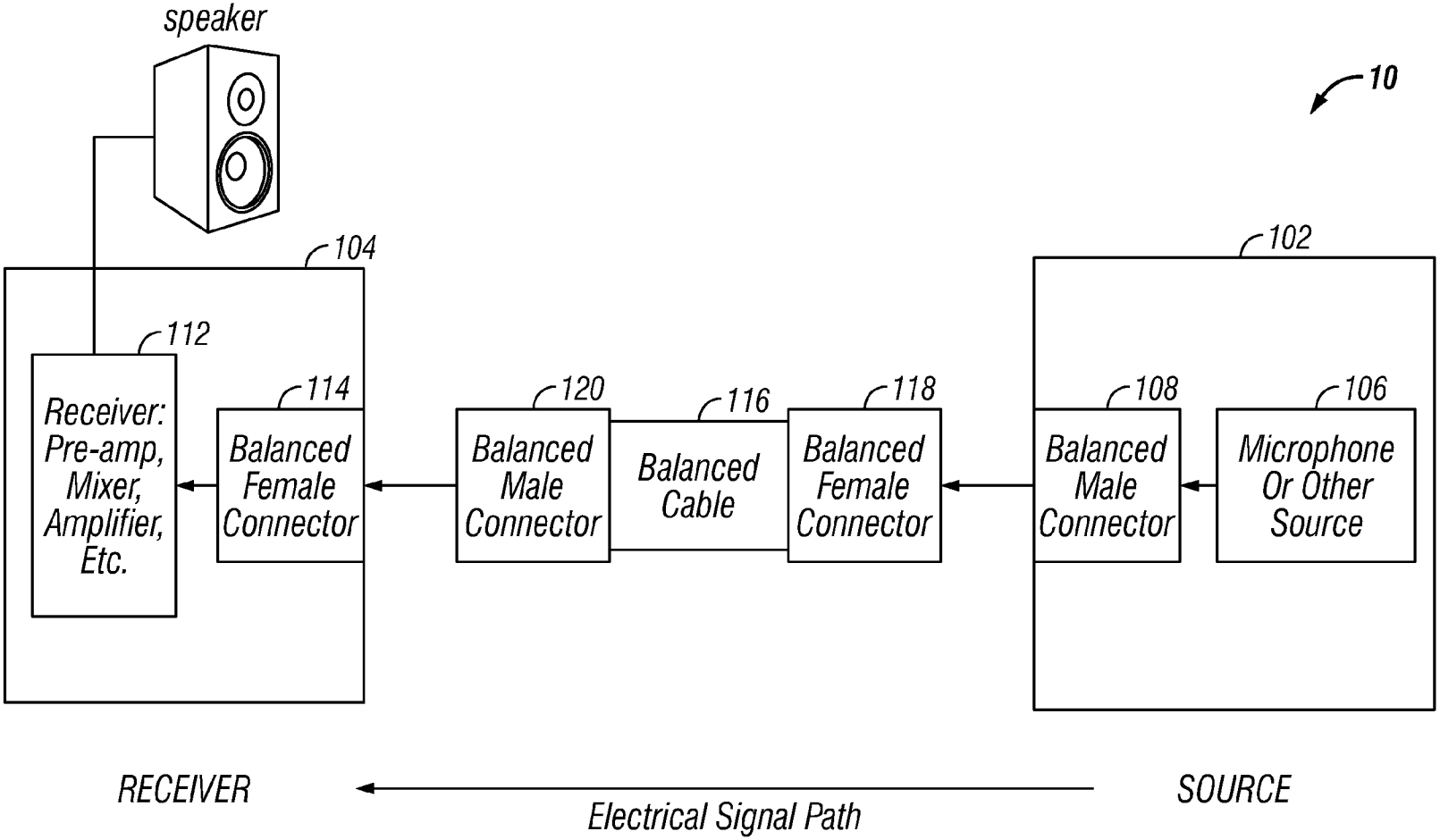
FIG. 1 illustrates an example balanced audio system with XLR connector.
Figure 2:
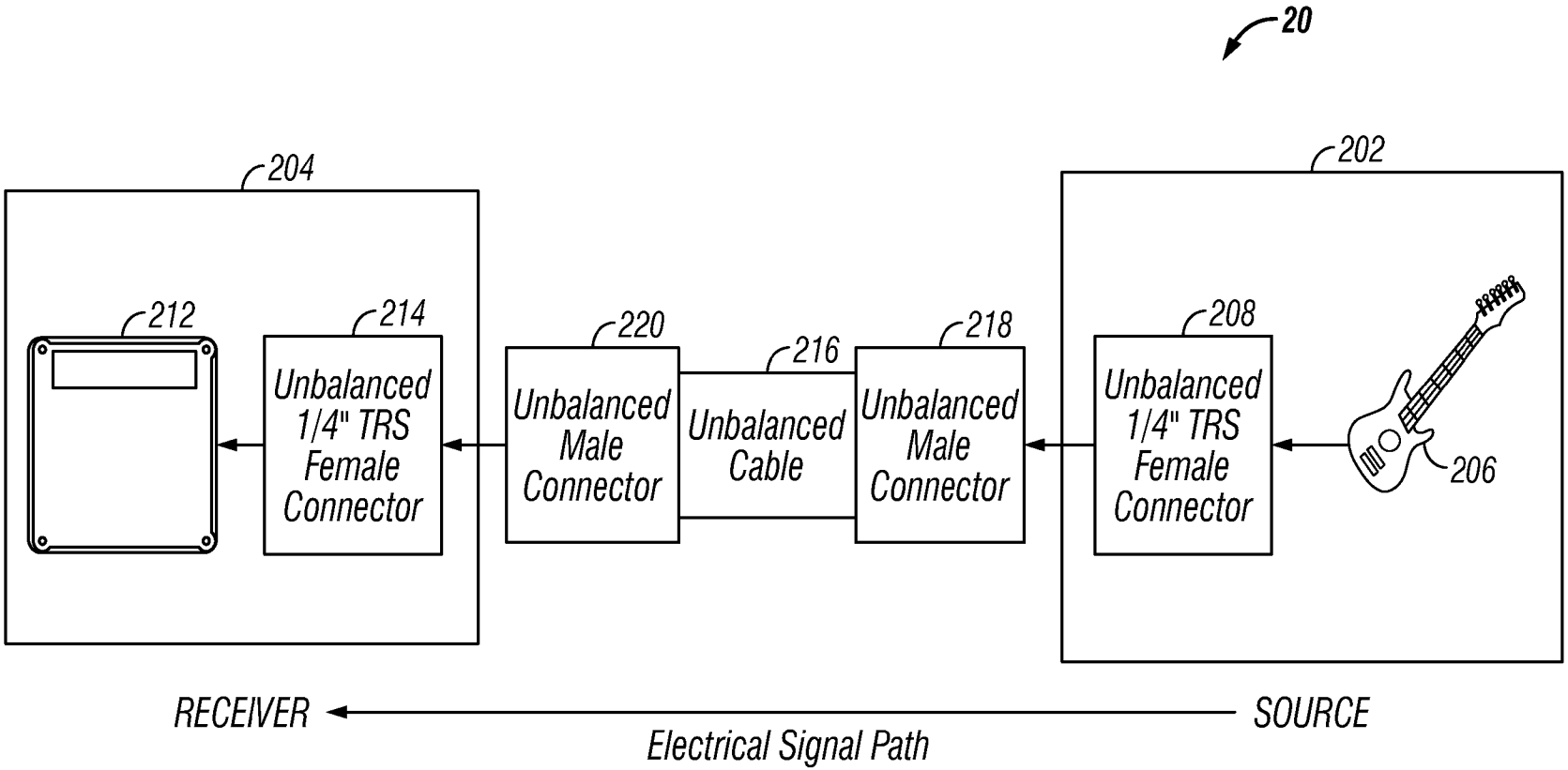
FIG. 2 illustrates an example unbalanced audio system with TRS connector.
Figure 3:
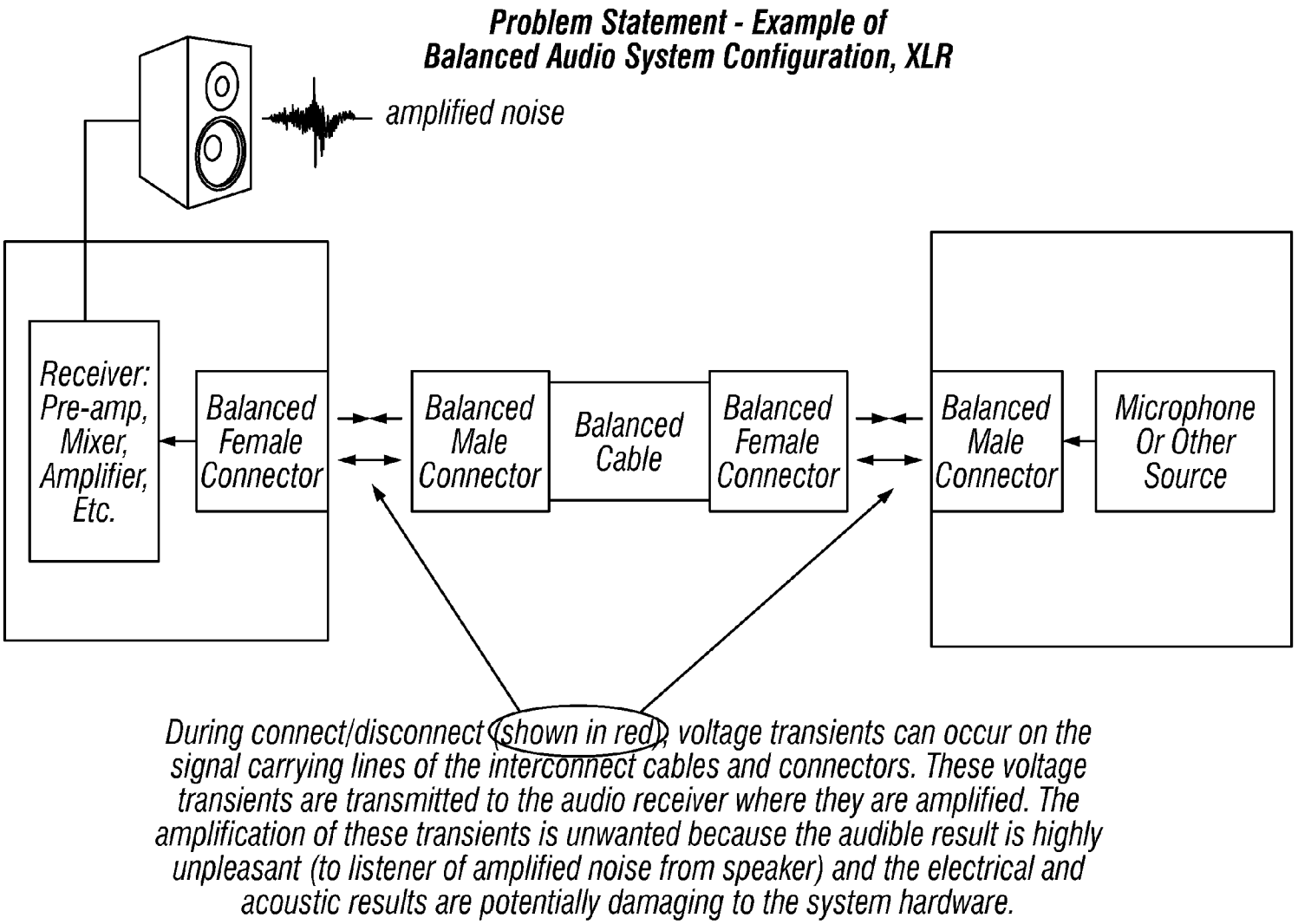
FIG. 3 illustrates the example balanced audio system with XLR connector of FIG. 1, indicating voltage transients that can occur on carrying lines leading to transient noise.
Figure 5:
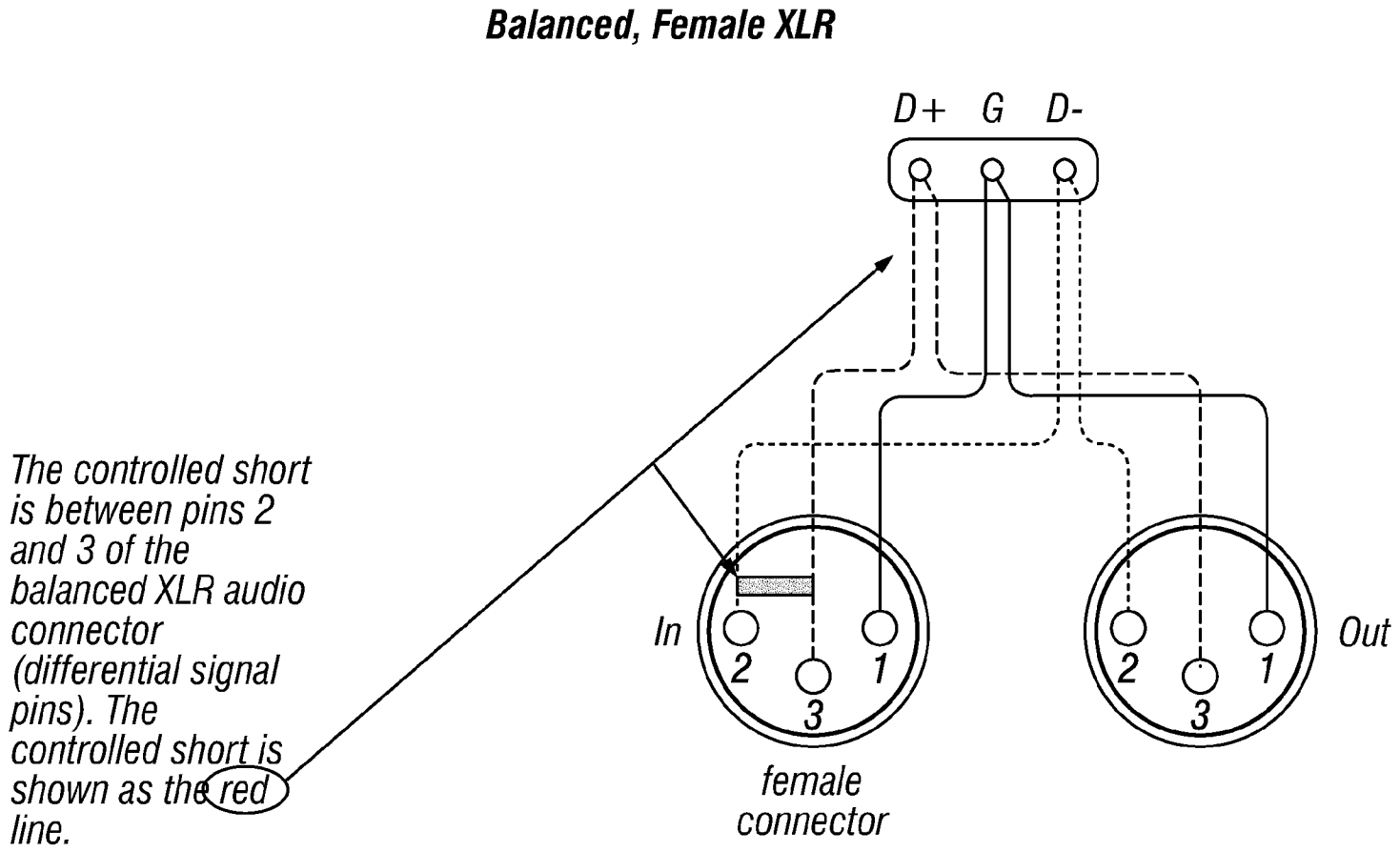
FIG. 5 illustrates an exemplary analog audio connector (XLR) for providing a low resistance short for balanced lines, according to certain embodiments of the invention.

In the connector 1300, the switch 1308 is biased to closed position when the connector 1300 (for example, a female connector) is not connected to a corresponding mated connector (for example, a male connector) of another device or cable (not shown in FIG. 1). When such corresponding mated connector is physically connected to the connector 1300, the physical connecting operation initially causes the mated connector, via pins or the like of the mated connector, to contact with the respective contacts 1302, 1304, 1306 of the connector 1300, thereby "making" connection. However, although this contact physically "makes" the connection, the electrical connection is not actually made until the connecting operation is continued and the connector 1300 mated sufficiently with the mated connector. Upon sufficient mating in the connecting operation, the switch 1308 of the connector 1300 is automatically "opened" at that point by the physical mating operation and only then is electrical connection between the connector 1308 and the mating connector established. The delayed electrical connection between the connector 1308 and the mating connector reduces or substantially eliminates any noise transient during connection operations between connectors/devices, because the switch 1308 transitions to open state only after contact has initially been made between the respective contacts 1302, 1304, 1306 of the connector 1300 and pins of the mated connector.

Furthermore, in the connector 1300, when disconnecting the electrical connection from the input device, the switch 1308 of the connector 1300 is immediately triggered to its closed state through initial commencement of physical dislodgement of the connector 1300 from the mated connector. In this initial state, the respective contacts 1302, 1304, 1306 of the connector 1300 remain in contact with the pins of the mated connector; however, the switch 1308, once triggered to its closed state on initial physical dislodgment action, electrically disconnects the contacts 1302, 1304, 1306 and pins of the mated connector. The switch 1308 then remains closed as the physical disconnection operation proceeds through termination of contact between the contacts 1302, 1304, 1306 of the connector 1300 and pins of the mated connector by physical disengagement of the connector 1300 and the mated connector. Because the switch 1308 is closed by initial dislodgement action of the connector 1300 from the mated connector, before terminating contact between the respective contacts 1302, 1304, 1306 of the connector 1300 and pins of the mated connector, noise transient is reduced or substantially eliminated during disconnection operations between source and receiver.

In unabalanced lines, in comparison to the balanced signals D+/D− of FIG. 13, the switch 1308 connects between the single-ended signal line contact and the ground contact of the connector.

Referring to FIGS. 14A-D, a connector 1400, for example, a female XLR type connector, includes a capsule 1410 containing a first contact 1402, a second contact 1404, and a third contact 1406. The capsule 1410 is, for example, a substantially non-conductive, generally cylindrical solid, with a top 1410*a* and a bottom 1410*b*. The cylinder of the capsule 1410 includes a larger diameter portion near the bottom 1410*b* and a smaller diameter portion towards the top 1410*a*. A switch channel 1414*a-b* is formed in the bottom 1410*b* of the capsule 1410, between the first and second contacts 1402, 1404, and continuing on opposing side of the second contact 1406. The capsule 1410 may include cutout portions 1412 in a side of the cylinder. As will be understood, the cutout portions 1412 can provide fitting engagements for a corresponding plug connector 1420 (shown for illustration only as pins 1422, 1424, 1426 and base in FIGS. 14A-D). Although not shown in FIGS. 14A-D, the connector 1400, or portions thereof, may be clad in a shield or other outer housing, longitudinally surrounding the capsule 1410. The capsule 1410 may be formed of plastic, rubber, or other non-conductive material.

The contacts 1402, 1404, 1406, respectively, are each an electrically conductive cylinder extending concentrically within and through respective longitudinally formed holes 1418 of the capsule 1410, in substantially parallel but displaced relationship, cylindrically intermediate in the capsule 1410. At the top 1410*a*, the contacts 1402, 1404, 1406 each extend to near flush with top 1410*a*. At the bottom 1410*b*, the contacts 1402, 1404, 1406 may, but need not necessarily, extend beyond the bottom 1410*b*, such as for connection to source circuit, cable or the like, for example, a connecting cable for source and receiver devices or directly to circuits of source or receiver device. As will be understood, the contacts 1402, 1404, 1406 are arranged in the capsule 1410 for mating with respective corresponding pins 1422, 1424, 1426 of the plug connector 1420 (shown in simplified illustration only as the pins in FIGS. 14A-D), when the connector 1400 is connected to the plug connector 1420. The contacts 1402, 1404, 1406 may be formed of copper, steel, or other conductive material.

Within the switch channel 1414*a, b*, a switch 1430 connects two of the contacts, for example, the contacts 1402, 1406. The switch 1430 when triggered to "off" breaks electrical connection between the two contacts, and otherwise is "on" to electrically connect the two contacts. The switch 1430 is, for example, an SPST switch, triggered to "off" when the pin 1426 pushes against the switch 1430 within the contact 1406, upon completion of mating of the plug connector 1420 with the connector 1400. The switch 1430 is positioned in the contact 1406 such that the pin 1426 (during mating of the plug connector 1420 and the connector 1400) touches the contact 1406 prior to triggering to "off" the switch 1430 (during mating). Because the contacts remain electrically connected until the pin 1426 has touched the contact 1406 (during mating), the contacts 1402, 1406 remain shorted to source prior to the pin 1426 triggering the switch 1430 to "off" (during mating, but after physical contact between the pin 1426 and the contact 1406). Once the connector 1400 and the plug connector 1420 are mated, and thereby the switch 1430 is triggered to "off", the switch 1430 remains triggered to "off" (and the connection operable) until the connector 1400 is de-mated from the plug connector 1420. In disconnecting the connector 1400 and the plug connector 1420 from mating engagement, the pin 1426 initially proceeds along the contact 1406 away from engagement with the switch 1430. When the pin 1426 is disengaged from touching the switch 1430 (during disconnection of the plug connector 1420 and the connector 1400), the switch 1430 returns to "on" electrically connecting the contacts 1402, 1406, thereby shorting to source, even though the pin 1426 remains (at least momentarily) touching the contact 1406. The plug connector 1420 is disconnected from the connector 1400, and the switch 1430 remains "on" electrically shorting the contacts 1406, 1402 to source.

Figure 15A:
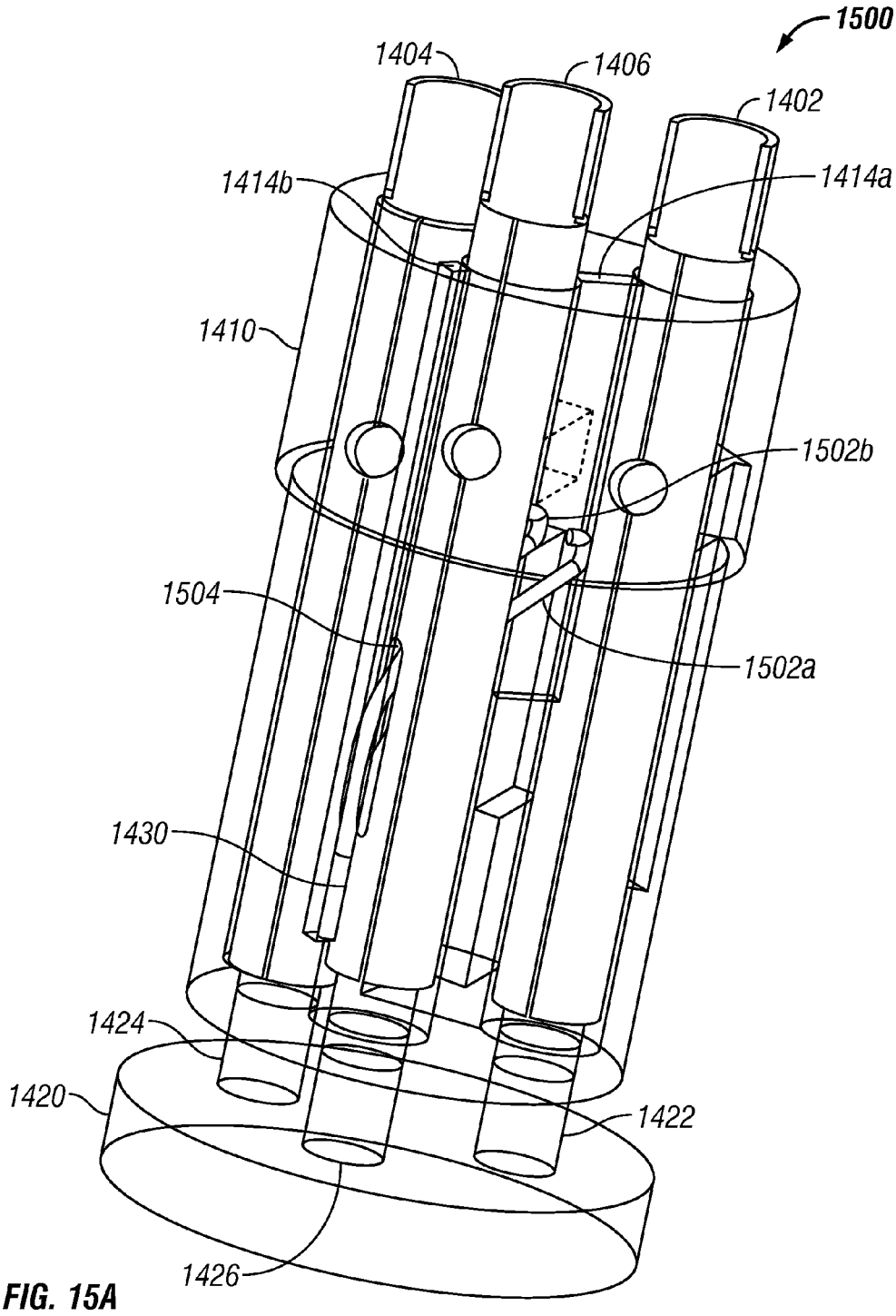
FIGS. 15A-C illustrate the exemplary female XLR connector of FIGS. 14A-D, with capsule and mate male connector in phantom, indicating open ("off") and closed ("on") positions of a switch, according to certain embodiments of the invention.
Figure 15B:
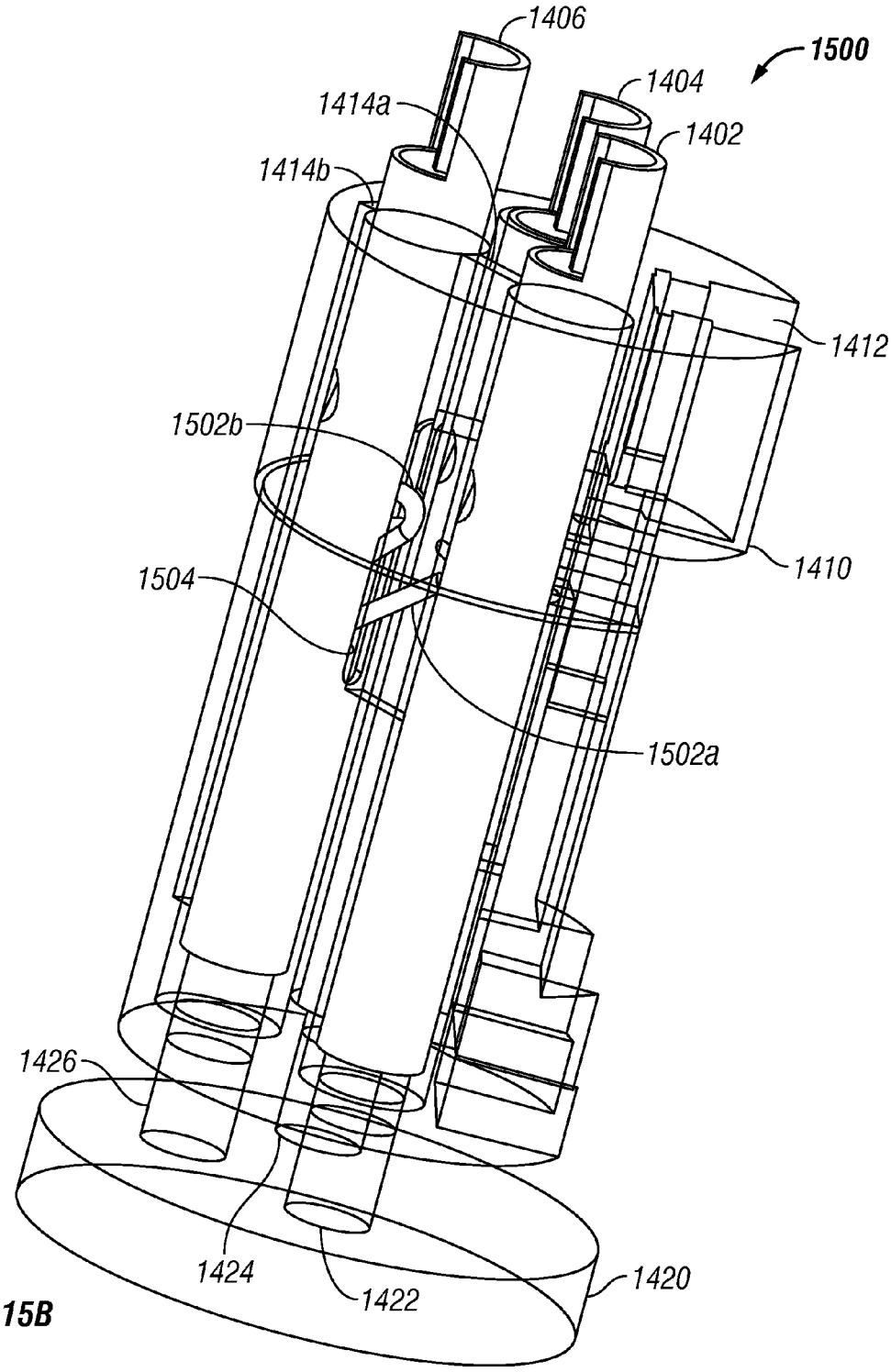
Figure 15C:
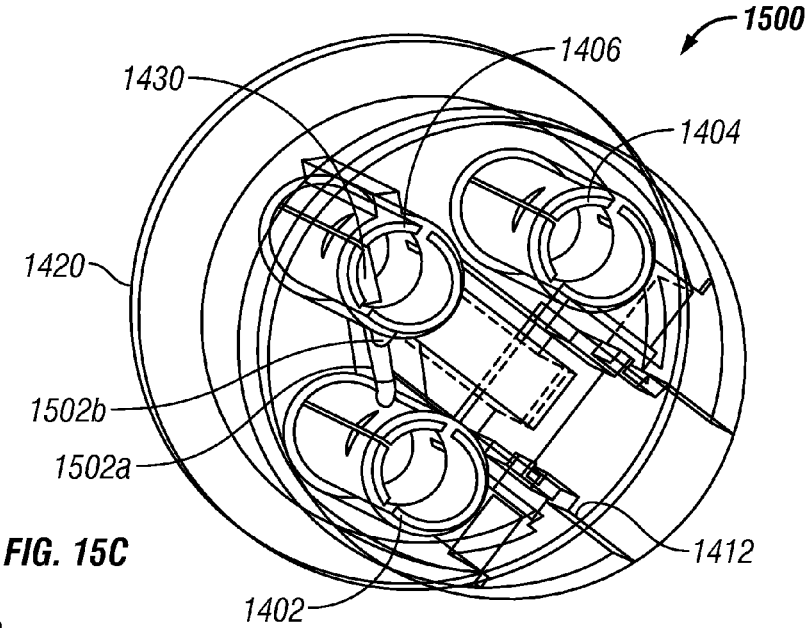

Referring to FIGS. 15A-C, in conjunction with FIGS. 14A-D, the switch 1430 is electrically connected to one of the contacts 1402, 1404, 1406, for example, the contact 1406 for purpose of illustration. In the example, the contact 1406 is formed with a side to side hole 1504 to accommodate the switch 1430 through the interior of the contact 1406. The switch 1430 is, for example, a conductive wire outwardly fixed to the contact 1406 and passing through the hole 1504 to opposingly extend from the hole 1504 towards another contact, for example, the contact 1402. The switch 1430 is formed and sized to touch the contact 1402 (shown as 1502*a*) when residing within the hole 1504 and extending from affixation to the contact 1406, through the hole 1504. This position 1502*a* is the "on" position of the switch 1430, when no pin has been lodged in and pressed (upwardly, in FIGS. 15A-B) in the contact 1406 to bend the wire of the switch 1430. The position 1502*b* is the "off" position of the switch 1430, obtained when the pin 1426 is pressed into engagement with the contact 1406 and thereafter continued upwardly (in FIGS. 15A-B) in engagement with the contact 1406 to press against and upwardly (in the Figs.) bend the wire of the switch 1430 away from the contact 1402. For avoidance of confusion, the switch 1430 is shown in FIGS. 15A-C in both "on" and "off" position; however, the positions 1502*a,b* are each the same wire of the switch 1430, albeit illustrated in the two different positions at different intervals.

The hole 1504 on each side of the contact, where the contact is cylindrical as with the contact 1406, is sized to allow the wire of the switch 1430 to freely move (within a range) longitudinally with the cylindrical extension of the contact 1406. The wire of the switch 1430 is arcuate in "on" position, in order to lead from attachment to the contact 1406, through the hole 1504, and into electrical connection with the contact 1402. However, when force is upwardly (in the Figs.) applied to the wire of the switch 1430 in the position 1502*a*, such as by the pin 1426 after it has first touchingly engaged the contact 1406, the wire of the switch 1430 is springingly bent upward by the pin 1426 and disengaged from electrical connection to the contact 1402 to the "off" position.

In FIGS. 15A-C, the capsule 1410 and plug connector 1420 with pins 1422, 1424, 1426 are shown in phantom for purposes of understanding the switch 1430 and its operations.

Figure 16A:
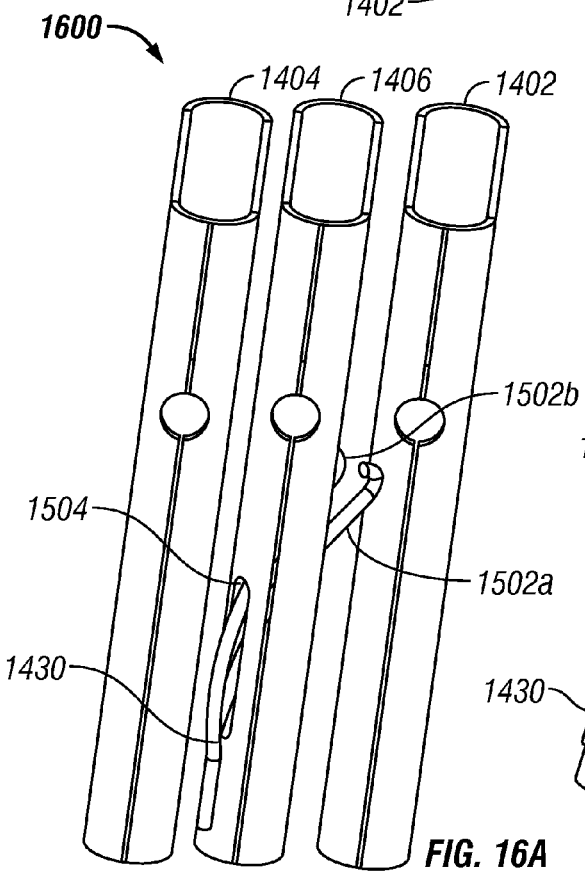
FIGS. 16A-C illustrate contacts and switch, in "on" and "off" positions, of an exemplary female XLR connector, according to certain embodiments of the invention.
Figure 16B:
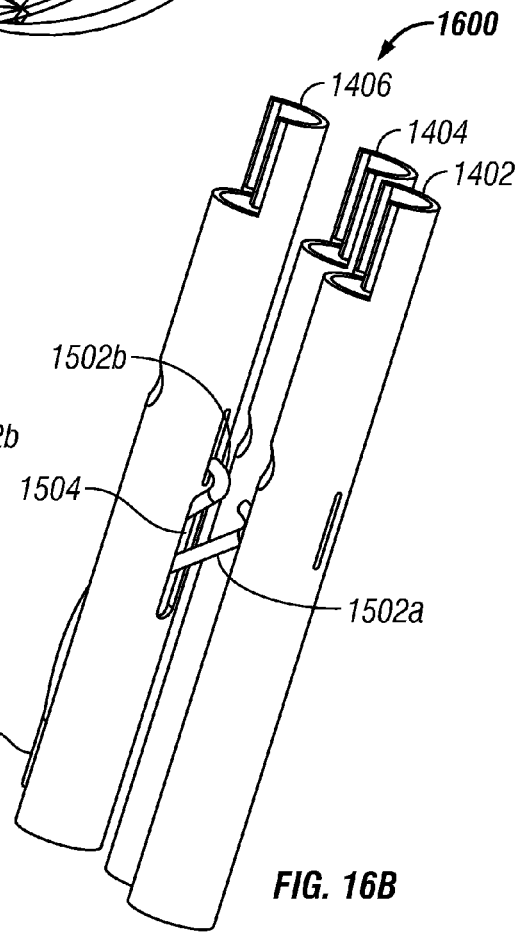
Figure 16C:
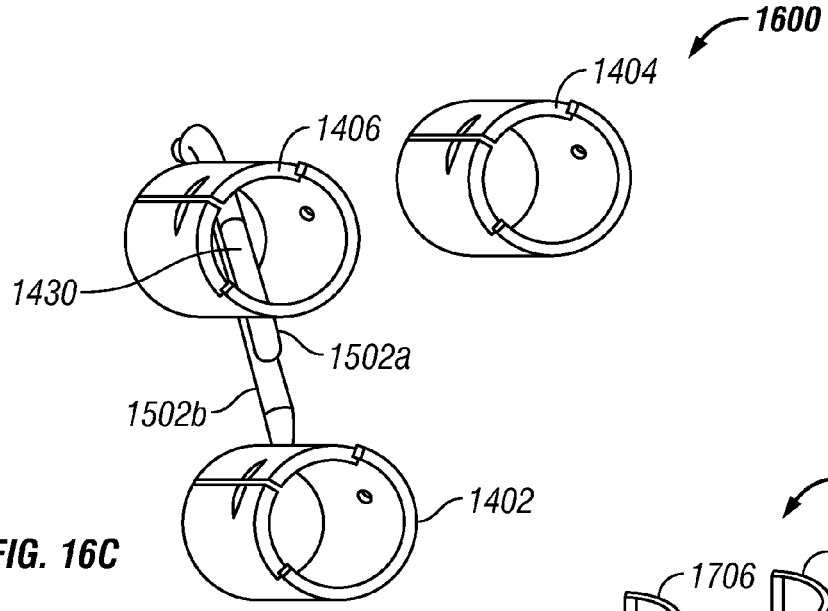

Referring now to FIGS. 16A-C, in conjunction with FIGS. 14A-D and 15A-C, the switch 1430 and contacts 1402, 1404, 1406, for purposes of greater clarity, are shown without the capsule 1410 and plug connector 1420. The switch 1430 is electrically connected, for example, fixed, attached or incorporate to, the contact 1406. The switch 1430 extends intermediately through the contact 1406, via the hole 1504, and out of the opposing hole 1504, towards the contact 1402. The switch 1430 has either position 1502*a* (i.e., "on") or position 1502*b* (i.e., "off"). The switch 1430 is to be understood as a single wire or trigger, however, both "on" position 1502*a* and "off" position 1502*b* are illustrated for purpose of explanation. The wire of the switch 1430 is formed and sized to extend from connection to the contact 1406, through the hole 1504 on opposing sides of the contact 1406, and into electrical connection with the contact 1402. The wire of the switch 1430 is flexible, such that it can be upwardly (in FIGS. 16A-B) bent away from electrical connection with the contact 1402, when a pin (not shown) is pressed upwardly (in FIGS. 16A-B) along the contact 1406. The switch 1430 remains in "on" position 1502*a* unless and until forced upward (in FIGS. 16A-B) along the contact 1406, but within the range of the hole 1504; when a pin connected to the contact 1406 proceeds upward along the contact 1406 and engages and forces upward the wire of the switch 1430, the switch 1430 disconnects from electrical connection to the contact 1402 in "off" position 1502*b*.

Figure 17A:
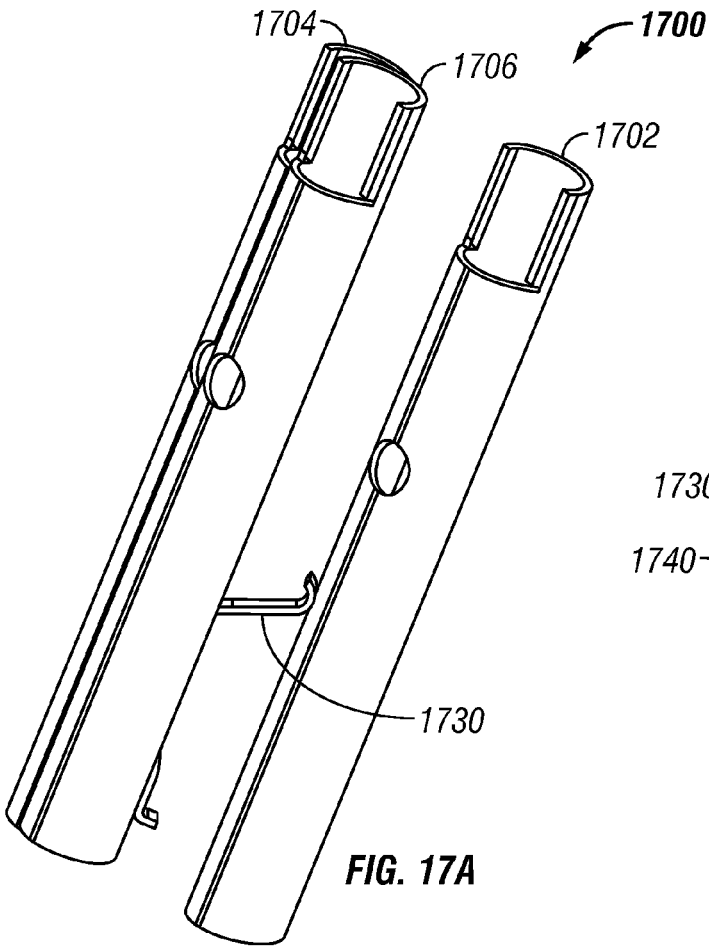
FIGS. 17A-C illustrate contacts and an alternative switch, in "on" position only, of an exemplary XLR connector, according to certain embodiments of the invention.
Figure 17B:
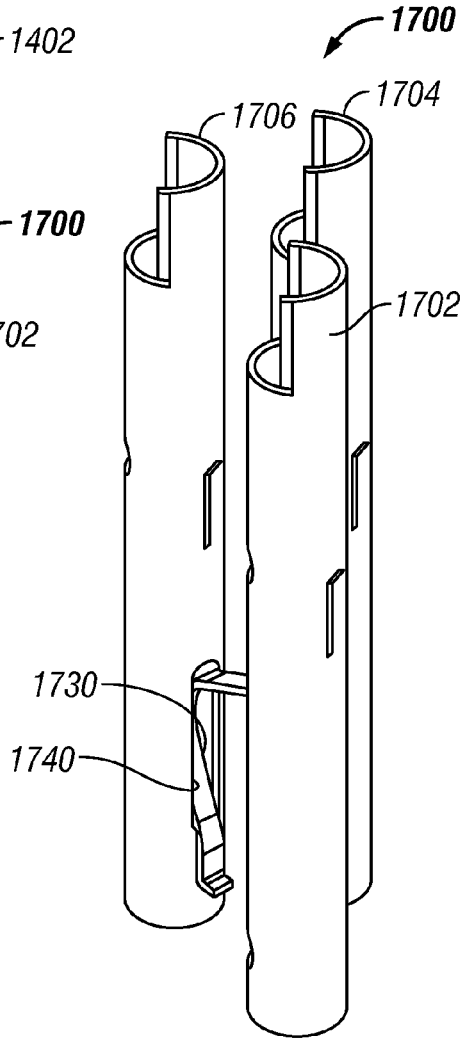
Figure 17C:
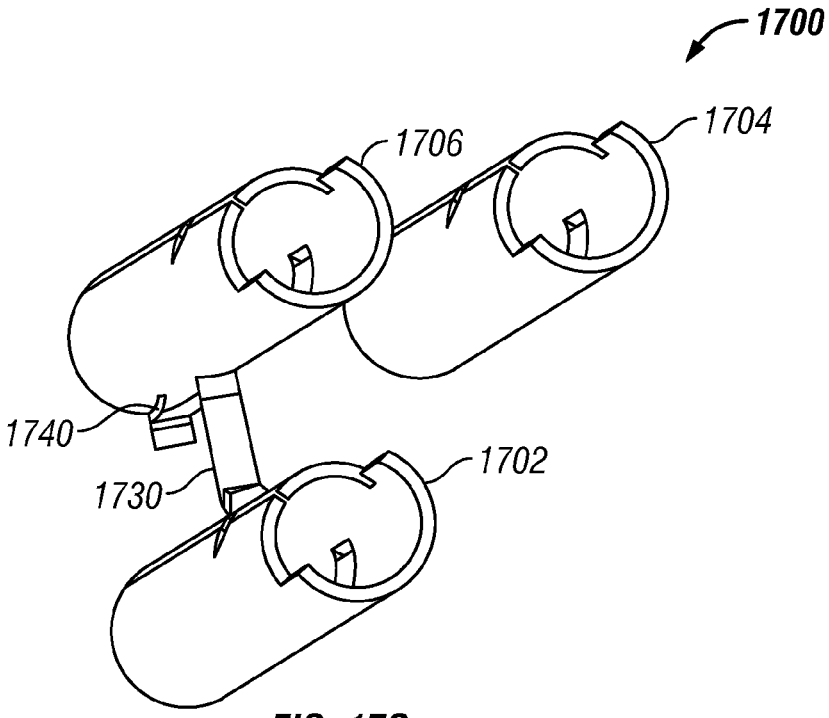

Referring to FIGS. 17A-C, an alternative switch 1730 and contacts 1702, 1704, 1706 include similar capsule 1410 and features of FIGS. 14A-D and 15A-C, but are shown without the capsule 1410 for purpose of explanation. One of the contacts, for example, contact 1706, includes a side hole 1740 extending longitudinally along the contact 1706. The hole 1740 is sized to accommodate the switch 1730, operative by a pin (not shown) engaged with the contact 1706, as now described. The switch 1730, for example, is a generally V, U, or Y-shaped conductive finger, fin, flange or similar wire. One extension of the switch is fixed to the contact 1760 in position for the crux, base, or intermediate portion of the V, U, or Y-shaped of the switch 1730 to reside extending into the hole 1740, with the other end of the switch 1730 contacting the another of the contacts, such as contact 1702. The switch 1730 is springingly flexible where extending within the hole 1740. The switch 1730 at one end is fixed or attached to, or incorporate in, the contact 1702 at one extent of the hole 1740 and rests towards the other end of the switch 1730 against another extent of the hole 1740. The switch 1730 may, but need not necessarily, include small wings, flanges, flares, hooks, bends, folds and other features to aid in retaining the switch 1730 positioned with the crux extending in the hole 1740. In certain embodiments, the capsule 1410 or other elements retain the switch 1730 in position. In any event, the switch 1730 connects, preferably but not necessarily fixedly (such as by welding, adhesive or other), to the contact 1706 and, until engaged by a pin, electrically connects the contact 1706 to the contact 1702.

The switch 1730 is capable of flexing in connection to the contact 1706. In particular in certain embodiments, the switch 1730 is in an "on" position, in which the switch 1730 electrically connects the contact 1706 and the contact 1702, unless the switch 1730 is triggered to "off" position. FIGS. 17A-C show the switch 1730 only in "on" position. A pin (not shown) can be engaged with the contact 1706, however, and, if after the pin touchingly engages the contact 1706, the pin is further forced along the contact 1706, the pin will press against the crux of the switch 1730. As the pin is pressed against the crux of the switch 1730, the switch 1730 is flexibly straightened (somewhat) against extents of the hole 1740. As the switch 1730 straightens, the switch 1730 disengages from electrical connection touching the contact 1702. This triggers (or moves) the switch 1730 to "off" position (not shown FIGS. 17A-C).

Figure 18:
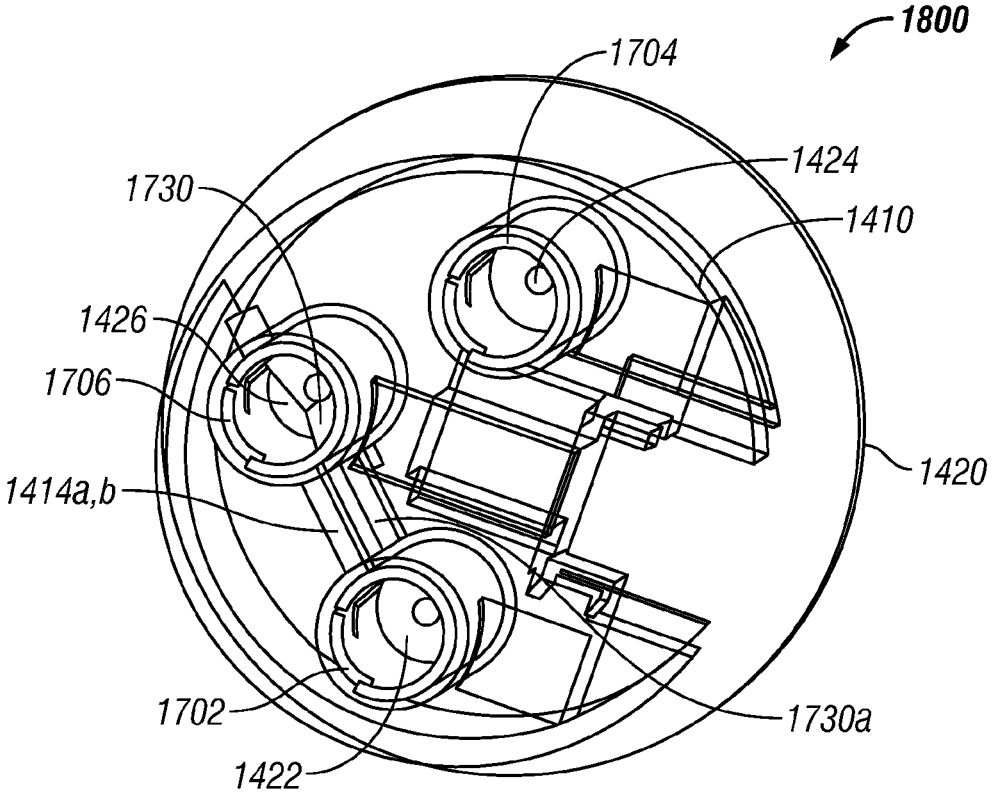
FIG. 18 illustrates the contacts and switch of FIGS. 17A-C in a capsule (in phantom) of an exemplary female XLR connector, and a mate male connector (in phantom), according to certain embodiments of the invention.

Referring to FIG. 18, in conjunction with FIGS. 17A-C, the switch 1730 and contacts 1702, 1704, 1706, are shown with the capsule 1410 and plug connector 1420 in phantom. The pin 1426 of the plug connector 1420 is touchingly engaged with the contact 1706, however, is just commencing engagement with the switch 1730. As the pin 1420 is further forced in engagement with the contact 1706 (i.e., outwardly in FIG. 18), the pin 1420 presses against the crux of the switch 1730 and the bend of the switch 1730 is straightened. The extension 1730*a* of the switch 1730 connected to the contact 1702 becomes displaced from the contact 1702 and inclines towards the contact 1706. The switch 1730 is triggered to "off" position, on displacement from connection to the contact 1702.

In operation, the switch 1430 or 1730, as applicable, is triggered to "off" position, thereby completing connection of a source and receiver device or cable or circuit for such connection, only after pins are touchingly engaged in connection to contacts and one pin is forced against the switch 1430, 1730 during completion of mating of respective connectors. The switch 1430 or 1730, as applicable, returns to "on" position, electrically connecting between two contacts, as the pin against the switch 1430, 1730 is commenced in dislodgement, but while the pins remain engaged in connection with the contacts, during disconnection of the respective connectors.

Figure 19:
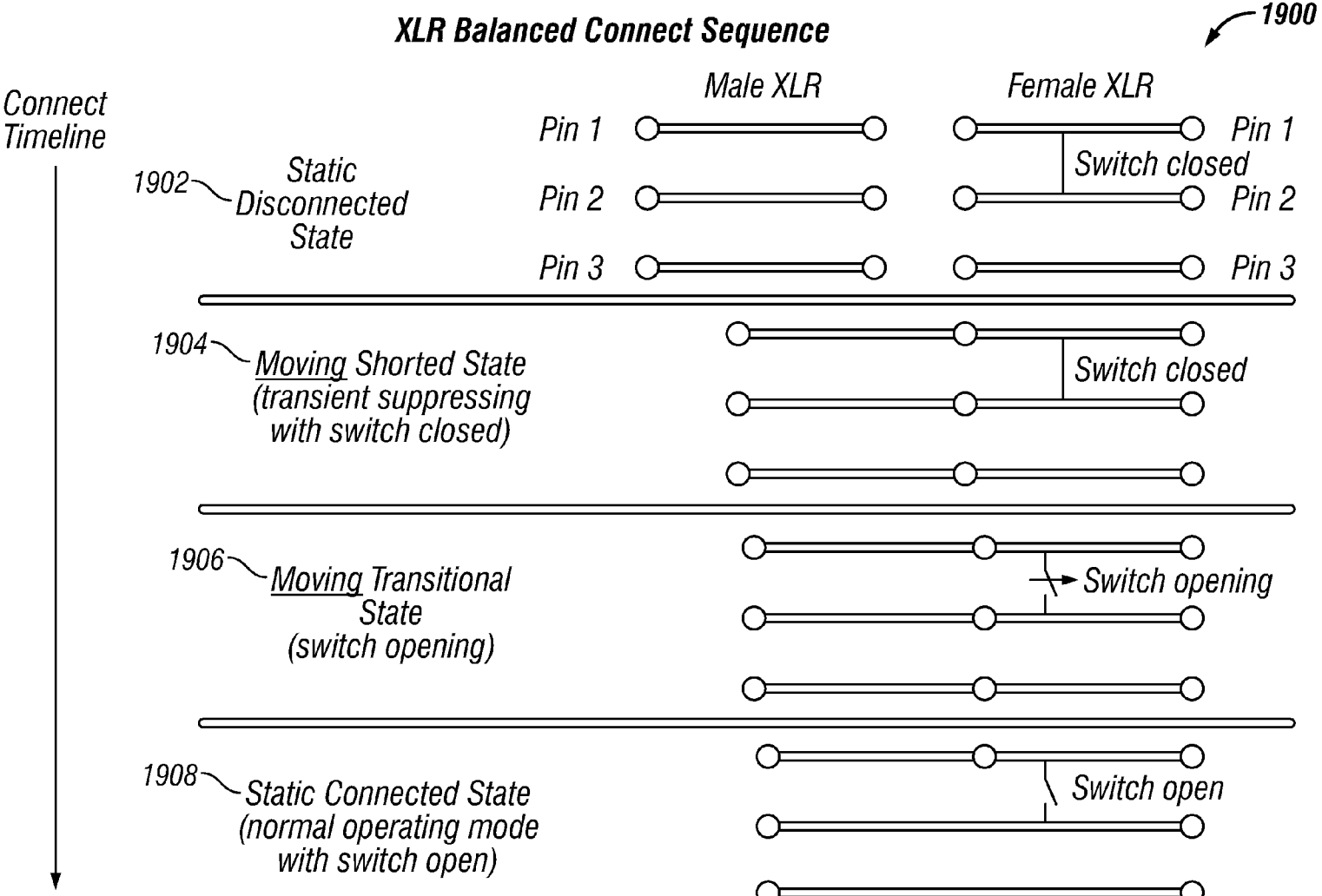
FIG. 19 illustrates a connect and switching process for a male XLR connector and a female XLR connector having a switch, according to certain embodiments of the invention.

Referring to FIG. 19, a connecting and switching process 1900 is illustrated for a male XLR connector and a female XLR connector having a switch according to embodiments. Initially, the process commences in a step 1902 with the two connectors not mated. In the step 1902, the switch is closed or "on" electrically connecting two contacts, such as those identified for purposes of explanation as "Pin 1" and "Pin 2" in FIG. 19 (note that the identifications of these pins are intended only as an example, and particular pin designations can vary). In a step 1904, the pins of the male XLR connector are brought into electrical contact with the corresponding pins of the female XLR connector, in typical manner of mating connectors. The respective male and female pins, in contact, suppress transient noise because the switch remains closed or "on" upon this initial contact of respective pins. In a step 1906, as mating of the male and female connector is furthered, a pin (e.g., "Pin 1") of the male connector engages the switch connected to the corresponding pin (e.g., "Pin 1") of the female connector and dislodges the switch from electrical connection to between the pins (e.g., Pin 1 and Pin 2) of the female connector. The switch is thereby opened or "off", electrically disconnecting the two contacts (Pins 1 and 2) in the female connector. In a step 1908, static connected state exists between the two connectors in normal operating mode for the mated connection, with the switch "off" or open.

Figure 20:
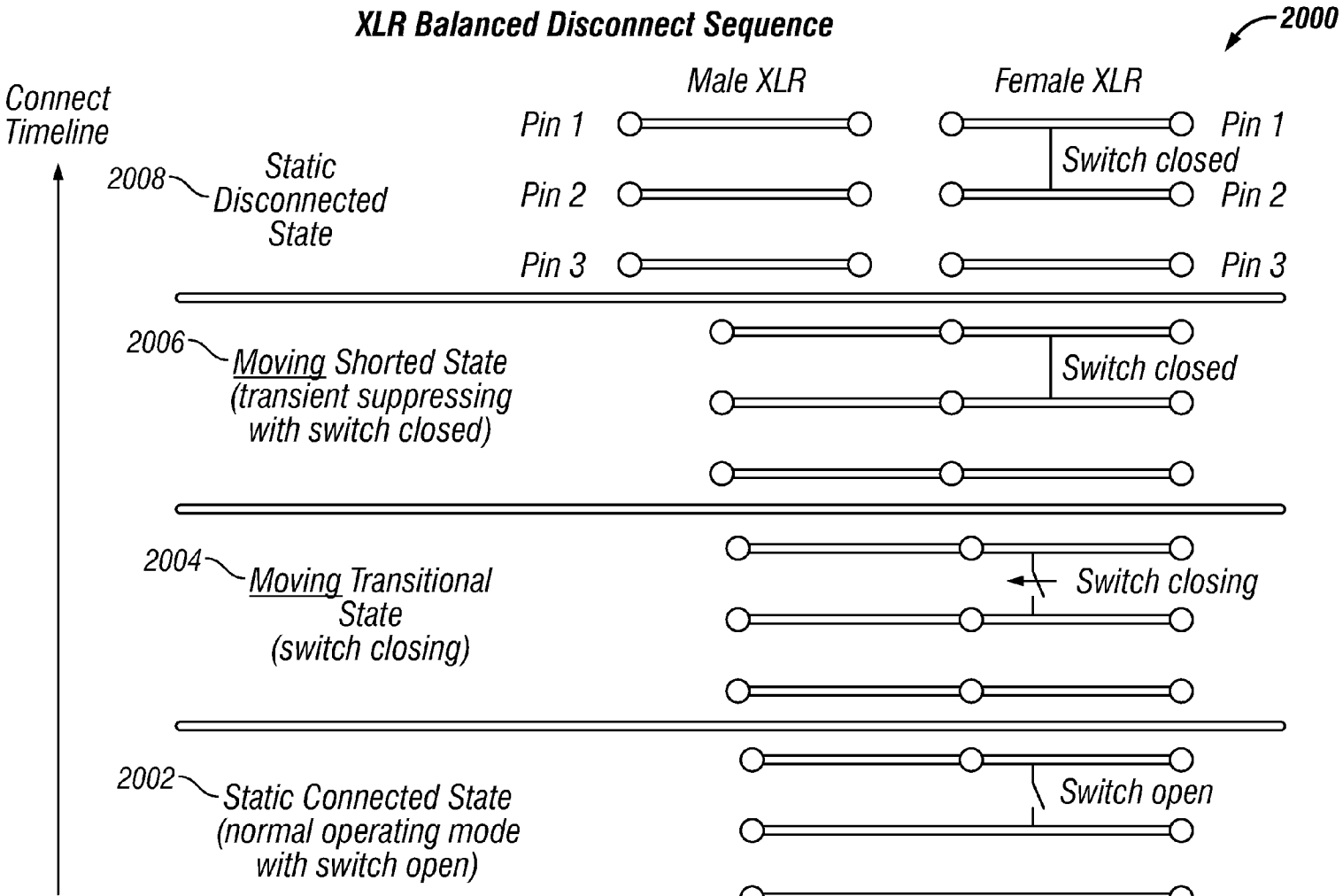
FIG. 20 illustrates a disconnect and switching process for a male XLR connector and a female XLR connector having a switch, according to certain embodiments of the invention.

Referring to FIG. 20, a disconnecting and switching process 2000 is illustrated for a male XLR connector and a female XLR connector having a switch according to embodiments. Initially, the process commences in a step 1902 with the two connectors mated and the switch open or "off, thereby the two contacts (e.g., "Pin 1" and "Pin 2" 0) are not electrically connected in the female connector. Static connection therefore exists between the two connectors in normal operating mode for the mated connection, with the switch "off" or open. In a step 1904, the pins of the male XLR connector are commenced to be withdrawn from electrical contact with the corresponding pins of the female XLR connector, in typical manner of disconnecting mating connectors. With the step 1904, a pin (e.g., "Pin 1") of the male connector is initially disengaged from the switch but the respective pins of the connectors otherwise remain in contact. As the pin of the male connector is disengaged from contact with the switch, but while the respective pins of connectors remain in contact, the switch automatically closes or turns "on", electrically connecting between pins (e.g., Pin 1 and Pin 2) of the female connector. With the switch turned "on", the male connector is continued in the disconnecting from the female connector in a step 2006, with respective pins of connectors remaining in contact. This delivers a shorted state for the pins connected by the "on" switch in the female connector, thereby suppressing transient noise from disconnection. Finally, in a step 2008, the connectors are disconnected.

Accordingly, the disclosed embodiments are applicable for a wide variety of connectors, including connectors in balanced and unbalanced systems, as well XLR, TRS, ¼ Phone Jack, and other types of 3-pin connectors.

Figure 6:
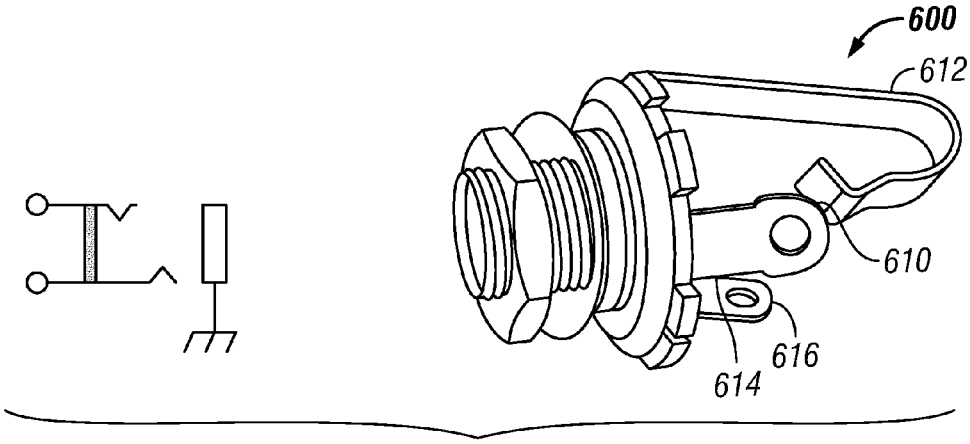
FIG. 6 illustrates an exemplary female analog audio connector (TRS) for providing a low resistance short for balanced lines, according to certain embodiments of the invention.

Referring to FIG. 6, a balanced female TRS connector 600 (without housing in FIG. 6) includes a switch 610 (i.e., providing the "controlled short"), between tip and ring contacts 612, 614 of the connector 600. The switch 610 is "on" electrically connecting the tip and ring contacts 612, 614, unless and until triggered to "off" (not shown) by a male connector disengaging the tip contact 612 from contact with the ring contact 614. As will be understood, the male connector (e.g., a TRS plug) is inserted in the connector 600 into contact with the tip, ring and sleeve contacts 612, 614, 616, prior to thereafter triggering the switch 610 to "off" by disengagement of the tip and ring contacts 612 by the male connector plug.

Figure 7:
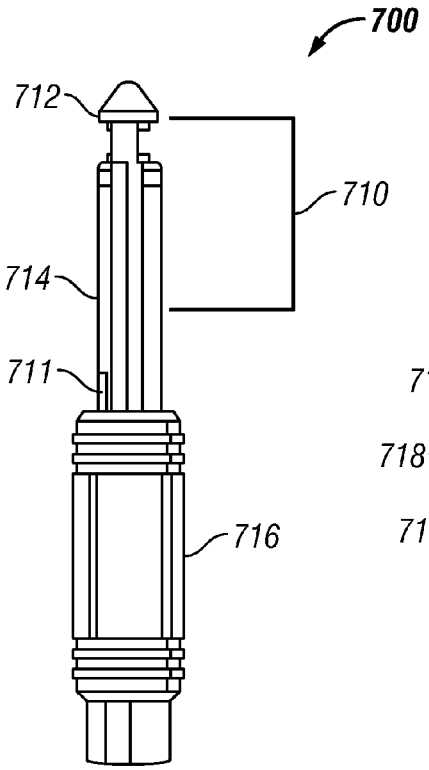
FIG. 7 illustrates an exemplary male analog audio connector (TRS) for providing a low resistance short for unbalanced lines, according to certain embodiments of the invention.
Figure 8A:
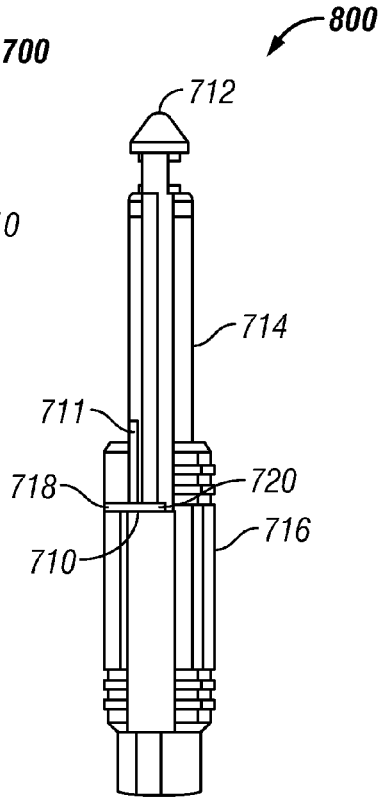
FIG. 8 illustrates an exemplary male analog audio connector (¼ Phono Jack) for providing a low resistance short for unbalanced lines, also illustrating actuation, according to certain embodiments of the invention.

Referring to FIGS. 7-8A-B, in conjunction, an unbalanced male TRS connector 700 includes a switch 710 (i.e., providing the "controlled short"), between tip and sleeve contacts 712, 714 of the connector 700. The switch 710 is "on" electrically connecting the tip and sleeve contacts 712, 714, unless and until triggered to "off" (not shown) by a female connector on contact and depression of an actuator 711 of the connector 700. The actuator 711 engages the switch 710 contained within an insulated cladding 716 of the connector 700.

Figure 8B:
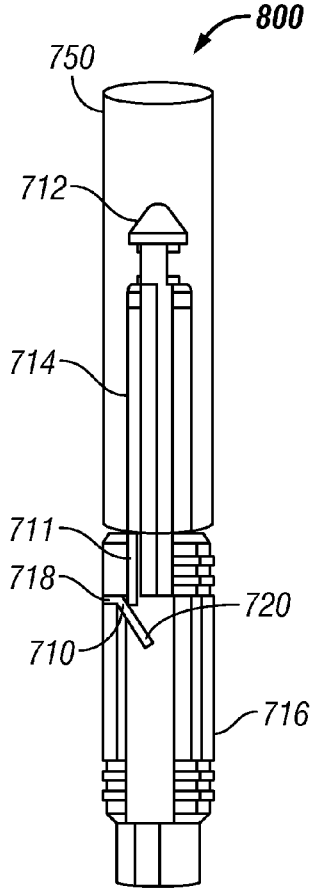
Figure 9:
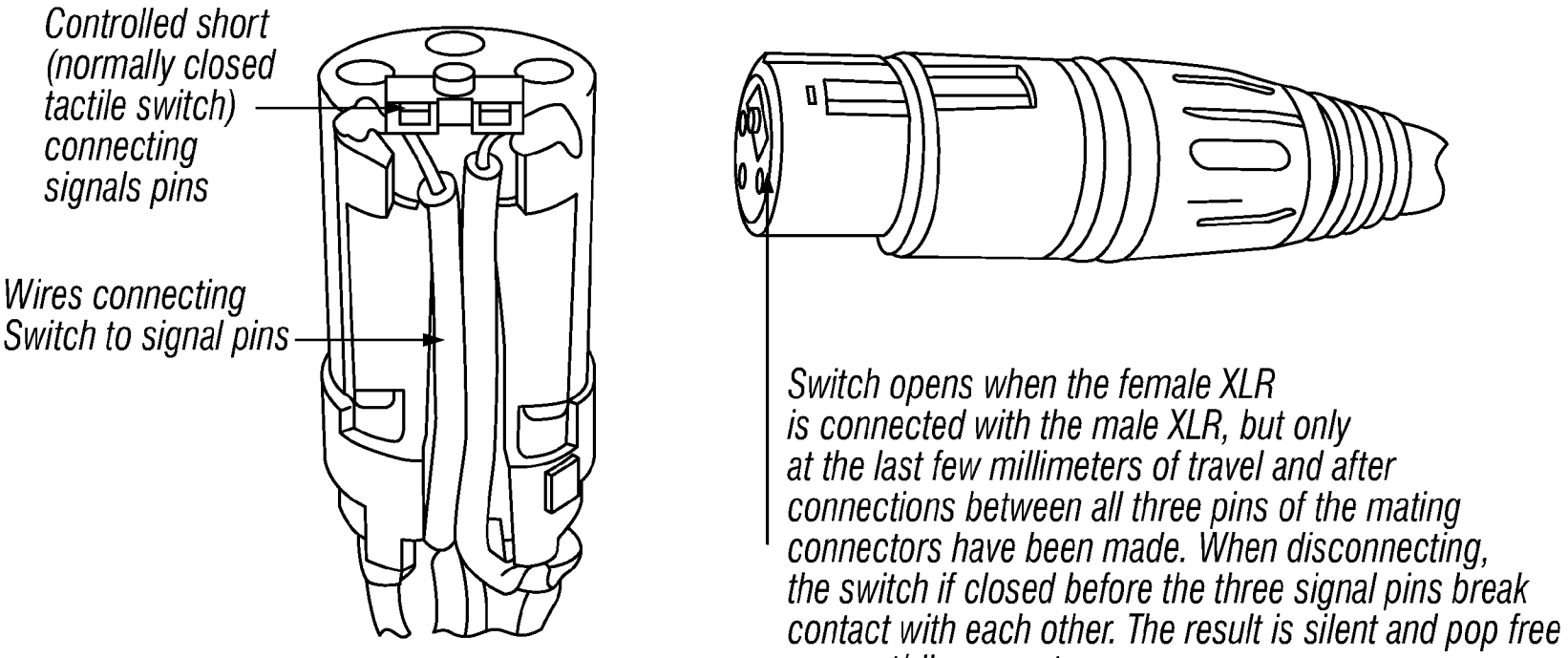
FIG. 9 illustrates an exemplary female analog audio connector (XLR) for providing a low resistance short for balanced lines, also illustrating switch actuation, according to certain embodiments of the invention.
Figure 10:
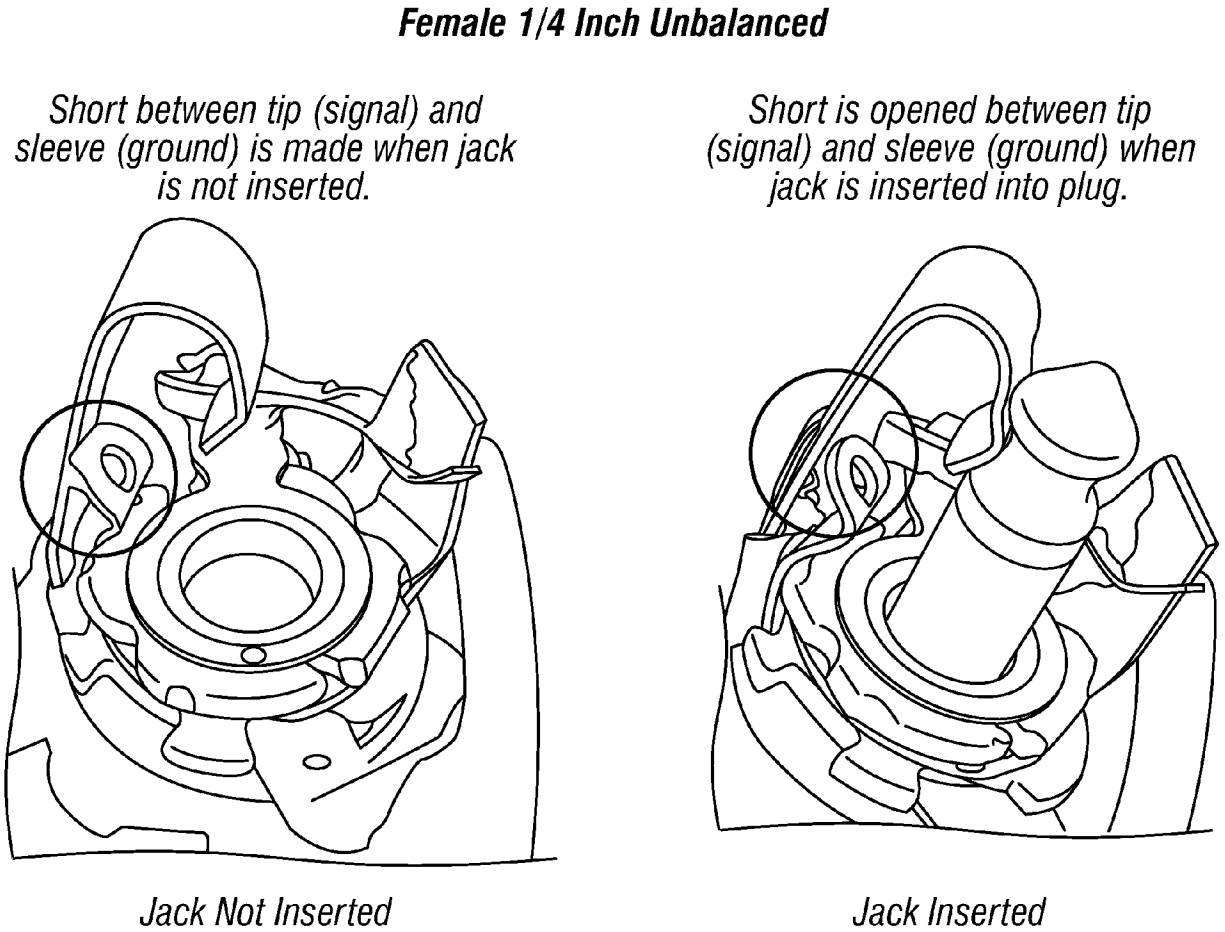
FIG. 10 illustrates an exemplary female analog audio connector (TRS) for providing a low resistance short for unbalanced lines, and view of female connector in connection to male connector, according to certain embodiments of the invention.
Figure 11:
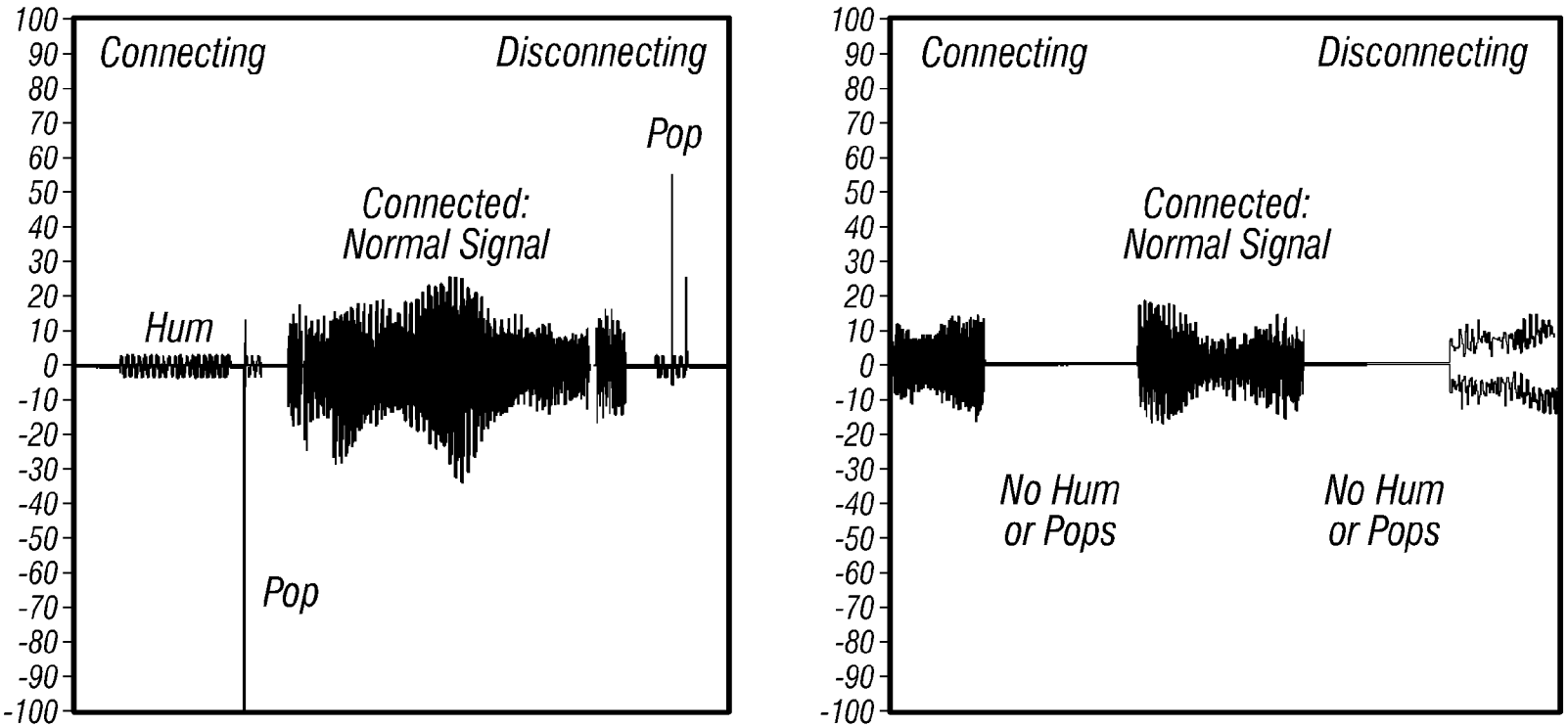
FIG. 11 illustrates exemplary test data for the female analog audio connector of FIG. 10, comparing conventional connector noise results to results obtained with the connector of FIG. 10, according to certain embodiments of the invention.
Figure 12A:
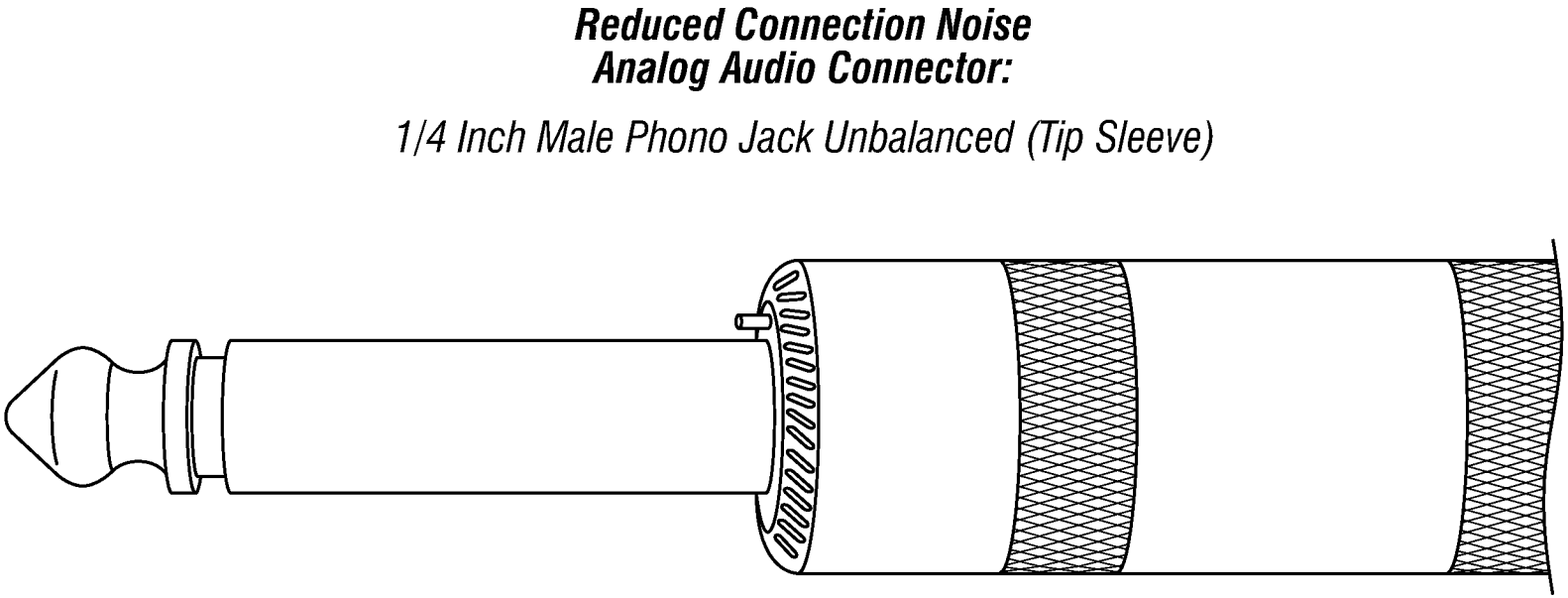
Figure 12B:
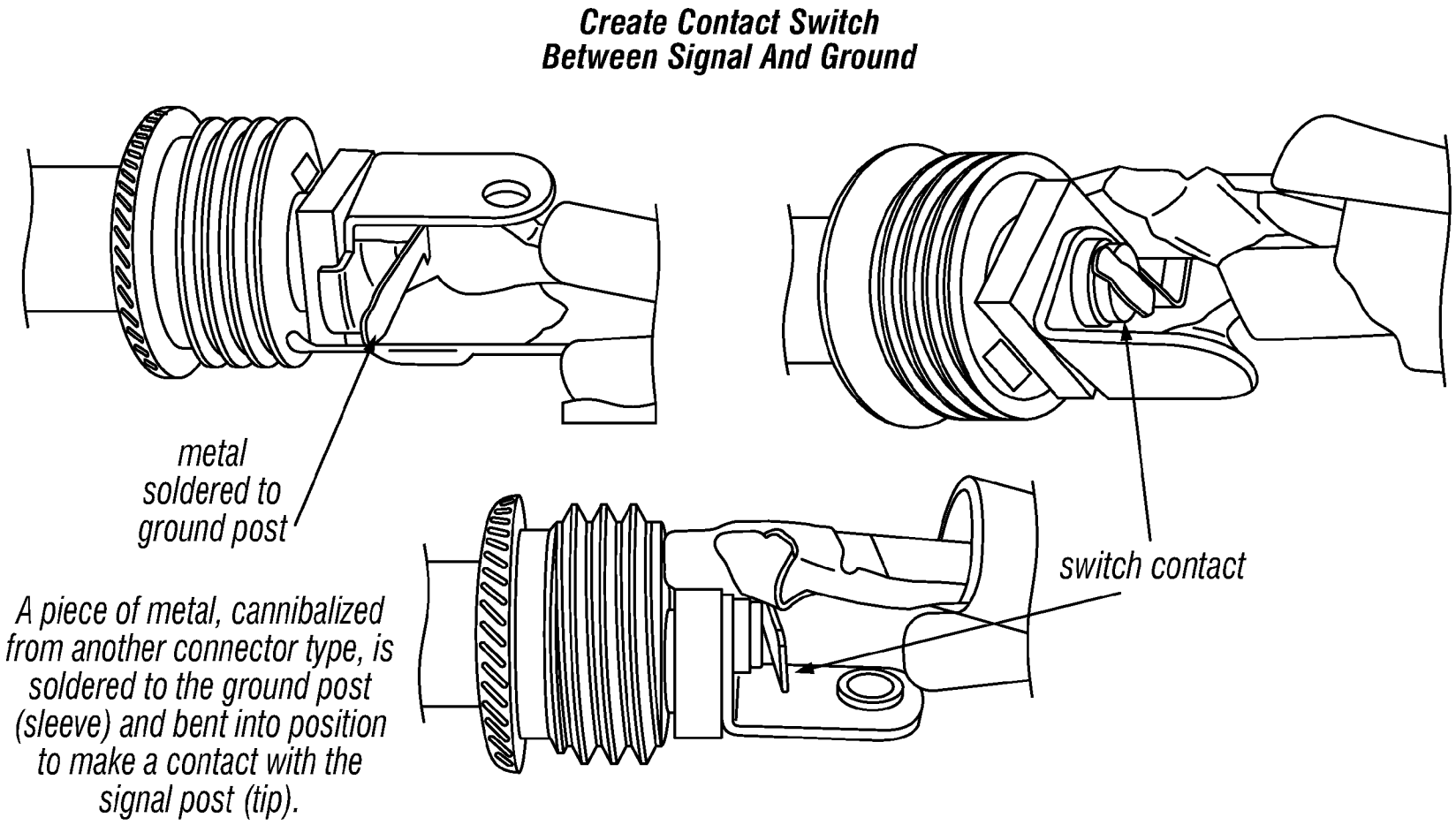
Figure 12D:
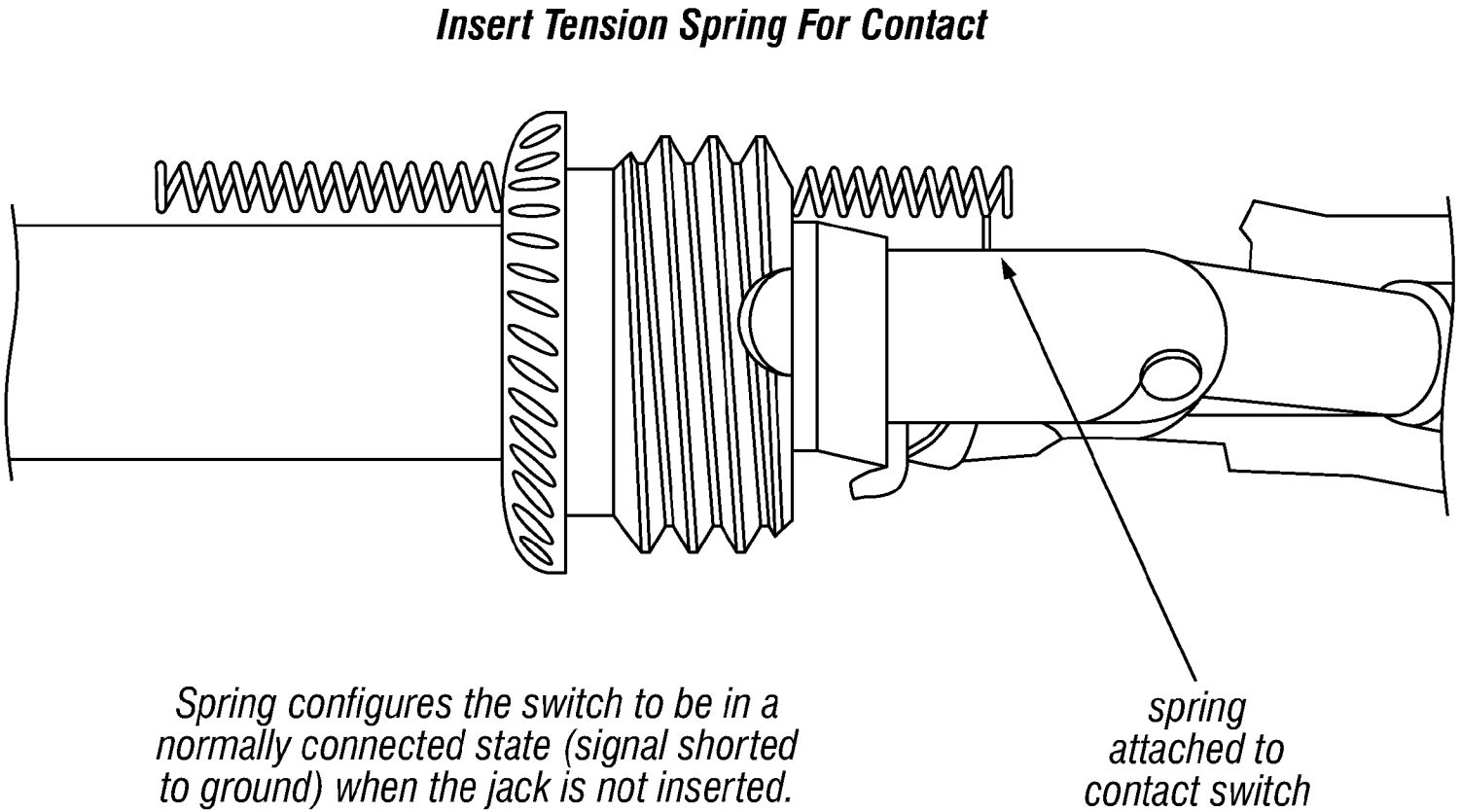
Figure 12E:
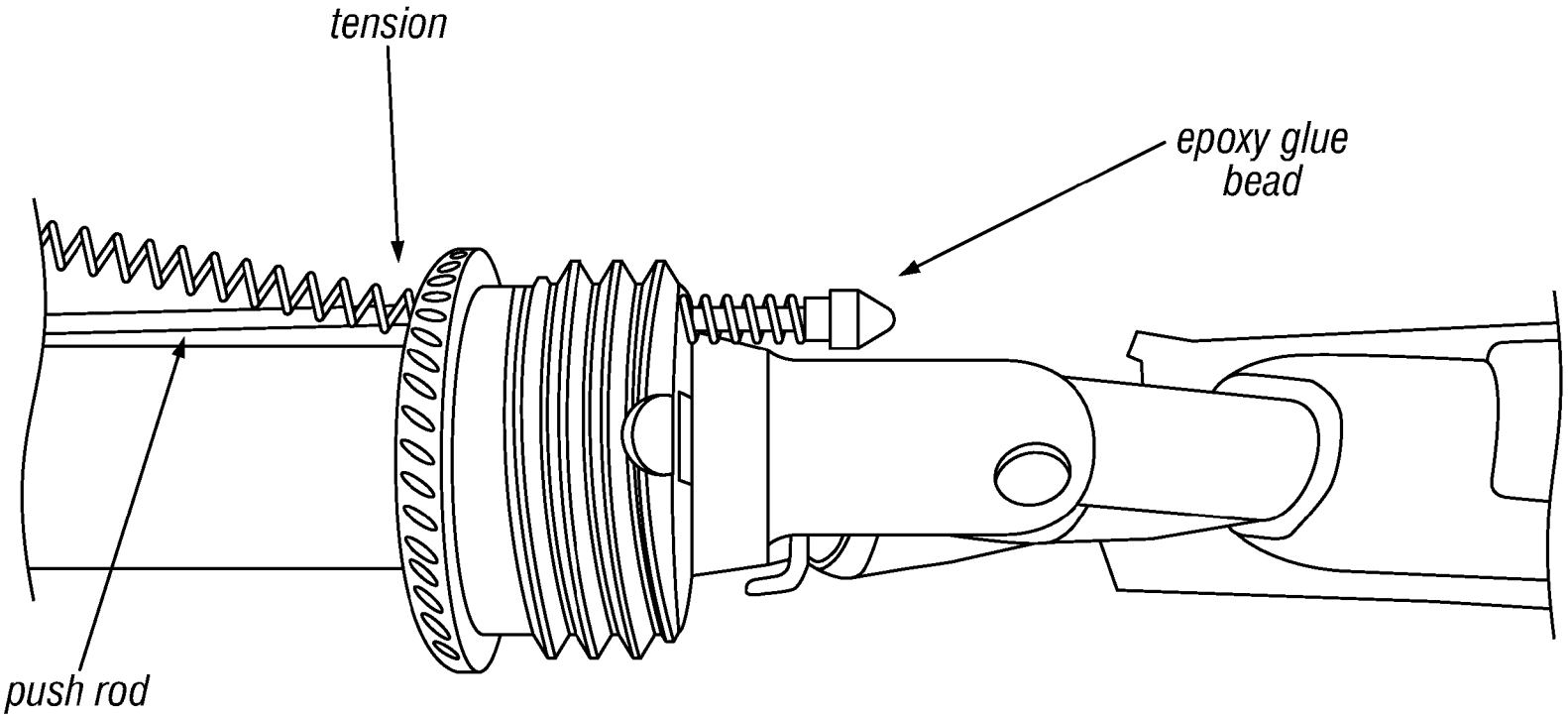
Figure 12F:
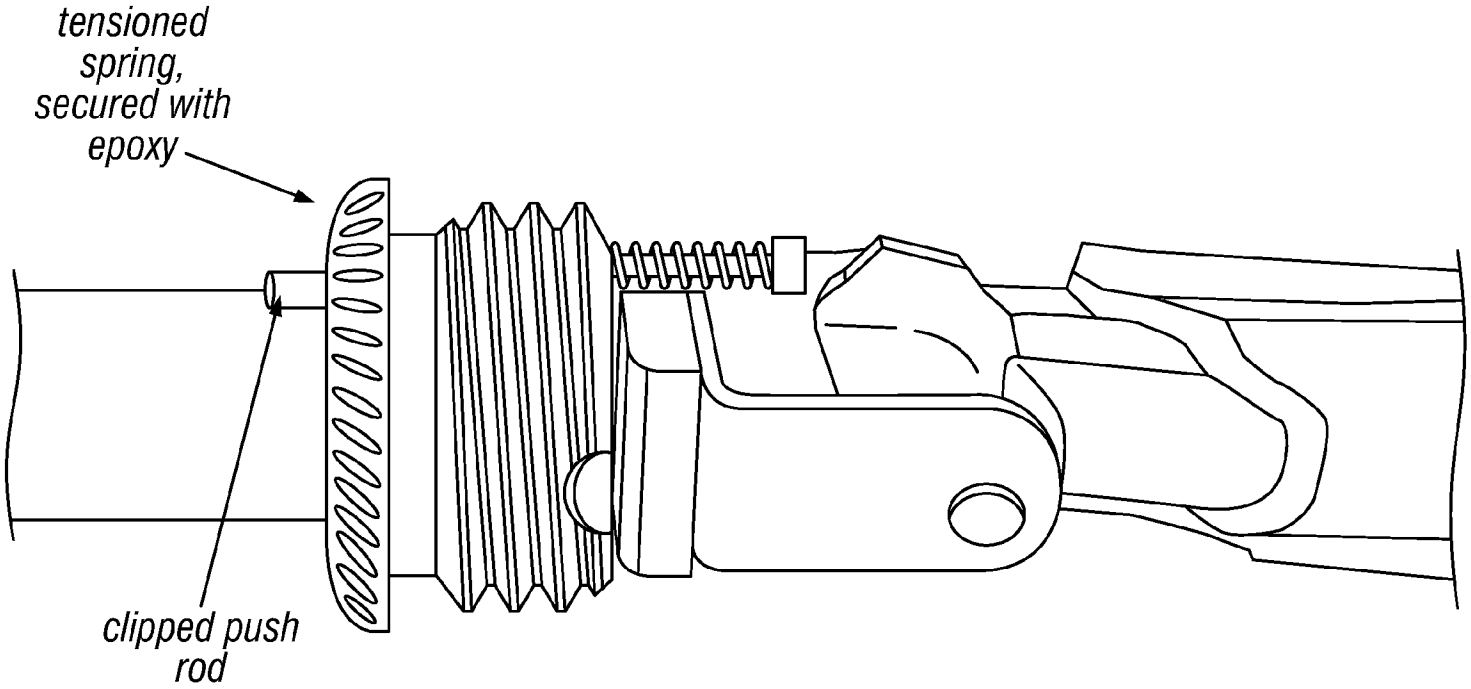
Figure 12G:
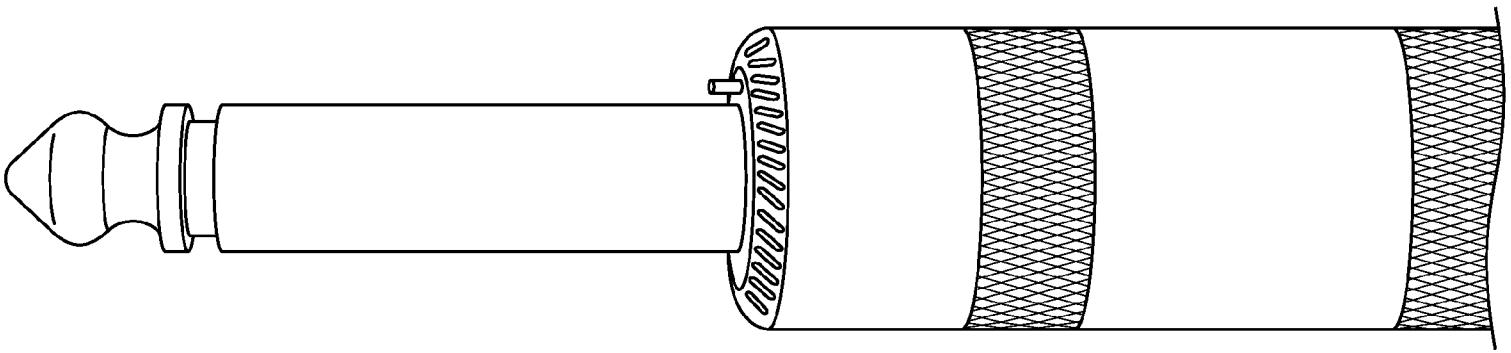

The switch 710 includes a sleeve conductor 718 and a tip conductor 720. The switch 710 is attached or fixed to, or incorporated with, the sleeve conductor 718. The switch 710 is, for example, a conductive plate or wire, extending from contact with the sleeve conductor 718. The switch 710 is movable with respect to the tip conductor 720, but biased to the tip conductor 710. The actuator 711, when depressed (downward in FIGS. 7 and 8A-B), disengages the switch 710 from contact with the tip conductor 720. FIG. 8 shows a female connector 750 (in phantom) with depressed actuator 711 on connection of the connector 700 with the female connector 750.

The switch 710 remains "on" connecting (i.e., shorting) the tip and sleeve contacts 712, 714 when not connected to a female connector (that is, when the actuator 711 is not depressed, as shown in FIG. 8A). When connecting to the female connector 750, the tip and sleeve contacts 712, 714 initially contact the corresponding tip and sleeve conductors of the female connector 750, however, the switch 710 remains "on" shorting tip and sleeve contacts 712, 714. Only after engagement of the tip and sleeve contacts 712, 714 with the corresponding tip and sleeve conductors of the female connector 750, and on continued mating of male and female connectors 700, 750, is the female connector 750 brought into engagement with the actuator 711 to depress it.

The tip and sleeve contacts 712, 714 are, therefore, shorted initially on connection of connectors 700, 750 and only upon completing mating of the connectors 700, 750 (i.e., after initial connection of respective contacts and conductors) is the actuator 711 depressed by the female connector 750 to open (i.e., turn off) the switch 710 for static operation of the connections. In disconnection of the connectors 700, 750, bias of the switch 710 triggers the switch 710 to closed (i.e., turns on) as the female connector 750 is commenced disconnecting from the male connector 700. At the point of the switch 710 triggering to on (thereby shorting between tip and sleeve of the connector 700), the tip and sleeve contacts 712, 714 remain in contact with the tip and sleeve conductors of the female connector 750. As the mated connectors 700, 750 are continued towards disengagement, the switch 710 remains on. Transient noise in connecting and disconnecting the connectors 700, 750 is thereby suppressed.

Figure 21:
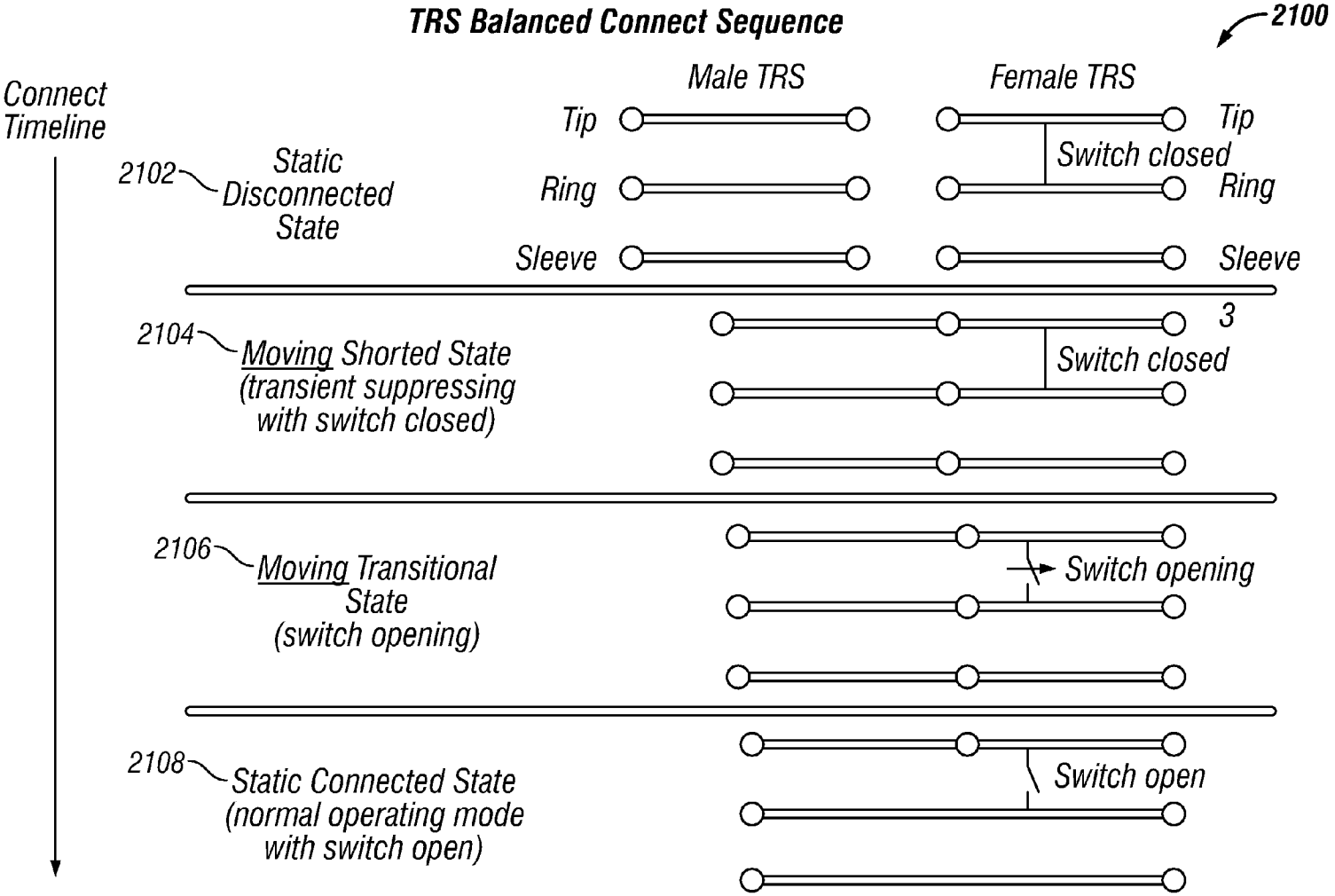
FIG. 21 illustrates a connect and switching process for a male TRS connector and a female TRS connector having a switch, according to certain embodiments of the invention.

Referring to FIG. 21, a connecting and switching process 2100 is illustrated for a male TRS connector and a female TRS connector having a switch according to embodiments. Initially, the process commences in a step 2102 with the two connectors not mated. In the step 2102, the switch is closed or "on" electrically connecting two contacts, such as those identified for purposes of explanation as "tip" and "ring" in FIG. 21 (note that the identifications of these pins are intended only as an example, and particular pin designations can vary). In a step 2104, the tip, ring and sleeve of the male TRS connector are brought into electrical contact with the corresponding conductors of the female TRS connector, in typical manner of mating connectors. The respective male and female tip, ring and sleeve conductors, in contact, suppress transient noise because the switch remains closed or "on" upon this initial contact of respective conductors. In a step 2106, as mating of the male and female connector is furthered, a tip conductor (e.g., "tip") of the male connector engages the actuator for the switch connected to the corresponding conductor (e.g., "tip") of the female connector and dislodges the switch from electrical connection to between the conductors (e.g., tip and ring) of the female connector. The switch is thereby opened or "off", electrically disconnecting the two the respective conductors (tip and ring) in the female connector. In a step 2108, static connected state exists between the two connectors (male and female) in normal operating mode for the mated connection, with the switch "off" or open.

Figure 22:
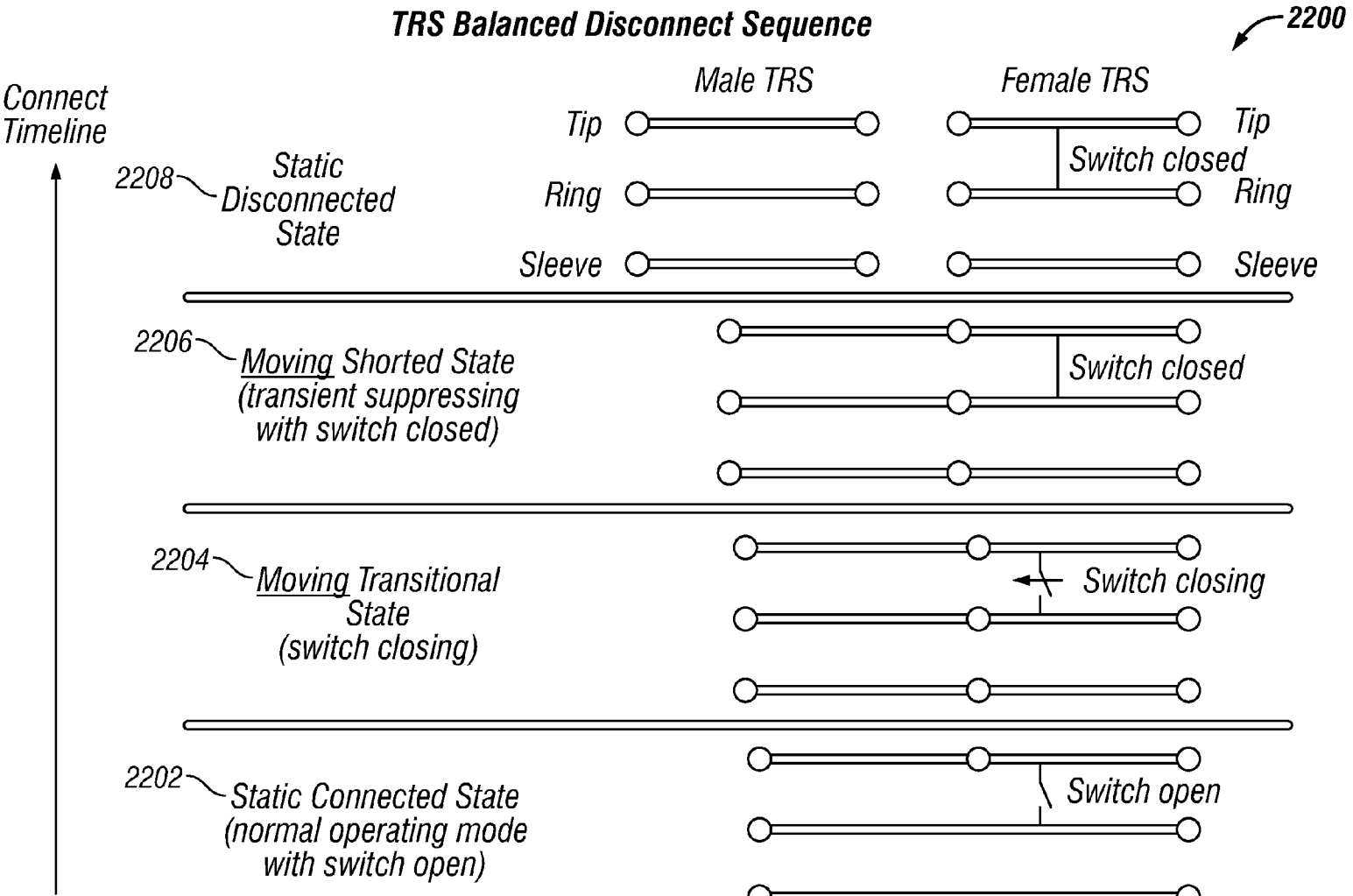
FIG. 22 illustrates a disconnect and switching process for a male TRS connector and a female TRS connector having a switch, according to certain embodiments of the invention.

Referring to FIG. 22, a disconnecting and switching process 2200 is illustrated for a male TRS connector and a female TRS connector having a switch according to embodiments. Initially, the process commences in a step 2202 with the two connectors mated and the switch open or "off, thereby the two conductors (e.g., "tip" and "ring") are not electrically connected in the female connector. Static connection therefore exists between the two connectors in normal operating mode for the mated connection, with the switch "off" or open. In a step 2204, the male TRS connector is commenced to be withdrawn from electrical contact with the female TRS connector, in typical manner of disconnecting mating connectors. In this step 2204, the female connector is initially disengaged from depressing the actuator of the switch, but the respective conductors (tip and ring) of the connectors otherwise remain in contact. As the female connector is disengaged from contact with the actuator, but while the respective conductors (tip and ring) of connectors remain in contact, the switch automatically closes or turns "on", electrically connecting (i.e., shorting) between conductors (e.g., tip and ring) of the female connector. With the switch turned "on", the male connector is continued in the disconnecting from the female connector in a step 2206, with respective conductors of connectors remaining in contact. This delivers a shorted state for the pins connected by the "on" switch in the female connector, thereby suppressing transient noise from disconnection. Finally, in a step 2208, the connectors are disconnected.

Reference is hereby made to the Appendix, and to FIGS. 3-5, 9-11 and 12A-G therein, attached hereto and incorporated herein as part of the present disclosure, for certain embodiments and further disclosure hereof.

A wide variety of alternatives are possible in the embodiments. For example, in certain embodiments of an XLR type connector, the switch of the connector is activated by a push rod type switch, such as, for example, shown in FIG. 8. In such instance, switch contacts can be located at an opposing end of the XLR connector capsule from that of the switch shown in the embodiment of FIG. 9. Other alternatives are also possible according to application and circumstances. For example, a short between a signal pin and a ground pin connected to an amplifier output of low output impedance may be damaging to the amplifier in some instances. Resistance of the short in the connector may be increased in such instance to limit current load on the amplifier output when shorted in connection and disconnection of the connector, such as by a series of resistors of the connector or otherwise. In some circumstances, transient noise may persist notwithstanding a short, as described, during connection and disconnection. In these cases, a passive noise filter may be included in the connector or otherwise to filter out high frequency transient noise when contacts change in connection or disconnection. Yet another approach to controlled switching by the connector in the embodiment is, or may include, use of phantom power, when available, for controlling the connector to switch electronically. For example, when phantom power is detected by the switch of the connector, switch may be from short to open and, when phantom power is not so detected, switch may be from open to short.

Though the foregoing and other portions of this disclosure reference or identify certain pins, contacts, and the like, as well as function and/or polarities, it is intended and should be understood that these may vary in practice and application, including, for example, according to country or regional standards or customs; therefore, particular references and identifiers are merely exemplary and not exclusive, and applicable alternatives and variations to accommodate all variations and alternatives for those standards and customs are included. Moreover, as will be understood from the foregoing and other portions of this disclosure, XLR type connectors, TRS type connectors, and other connectors are applicable in the embodiments. Additionally, sequence of operations in the disclosed embodiments may vary according to application and situation.

In the foregoing, the invention has been described with reference to specific embodiments. One of ordinary skill in the art will appreciate, however, that various modifications, substitutions, deletions, and additions can be made without departing from the scope of the invention. Accordingly, the specification and figures are to be regarded in an illustrative rather than a restrictive sense, and all such modifications are intended to be included within the scope of the invention. Any benefits, advantages, or solutions to problems that may have been described above with regard to specific embodiments, as well as device(s), connection(s), step(s) and element(s) that may cause any benefit, advantage, or solution to occur or become more pronounced, are not to be construed as a critical, required, or essential feature or element.

What is claimed is:

1. An electrical connector for connecting to ground and first and second signal lines, comprising:

a ground contact for connecting to ground;

a first signal contact for connecting to the first signal line;

a second signal contact for connecting to the second signal line;

a switch connected to the first signal contact and the ground contact, the switch is biased to "on" to electrically connect the first signal contact to the ground contact until after (i) the first signal contact is connected to the first signal line, (ii) the ground contact is connected to the ground, and (iii) the second signal contact is connected to the second signal line;

wherein the switch, during connection of the connector to ground and first and second signal lines, is thereby automatically triggered to "off" during connection of the connector, to electrically disconnect the first signal contact from the ground contact during connecting of the first signal contact to the first signal line, the ground contact to the ground, and the second signal contact to the second signal line.

2. An electrical connector for connecting to ground and first and second differential signal lines, comprising:

a ground contact for connecting to ground;

a first signal contact for connecting to the first differential signal line;

a second signal contact for connecting to the second differential signal line;

a switch connected to the first signal contact and the second signal contact, the switch is biased to "on" to electrically connect the first signal contact to the second signal contact until after (i) the first signal contact is connected to the first differential signal line, (ii) the ground contact is connected to the ground, and (iii) the second signal contact is connected to the second differential signal line;

wherein the switch, during connection of the connector to ground and the first and second differential signal lines, is thereby automatically triggered to "off" during connection of the connector, to electrically disconnect the first signal contact from the second signal contact after connecting of the first signal contact to the first signal line, the ground contact to the ground, and the second signal contact to the second signal line.

3. A circuit of an electrical connector, comprising:

a ground contact for connecting to ground;

a first signal contact for connecting to a first signal line;

a second signal contact for connecting to a second signal line;

a switch connected to the first signal contact and the ground contact, operative to electrically disconnect the first signal contact and the ground after the ground contact is connected to the ground, the first signal contact is connected to the first signal line, and the second signal contact is connected to the second signal line, and operative to electrically connect the first signal contact and the ground as the first signal contact is being disengaged from the first signal line but while, at least momentarily, the first signal contact continues to remain connected to the first signal line.

4. A circuit of an electrical connector, comprising:

a ground contact for connecting to ground;

a first signal contact for connecting to a first differential signal line;

a second signal contact for connecting to a second differential signal line;

a switch connected to the first signal contact and the second signal contact, operative to electrically disconnect the first signal contact and the second signal contact after the ground contact is connected to the ground, the first signal contact is connected to the first differential signal line, and the second signal contact is connected to the second differential signal line, and operative to electrically connect the first signal contact and the second signal contact ground as the first signal contact is being disengaged from the first differential signal line but while, at least momentarily, the first signal contact continues to remain connected to the first differential signal line.

5. A switch of a connector, the connector includes a ground contact, a first signal contact and a second signal contact, the connector capable of mating with a ground and first and second signal lines, for electrical connection and disconnection of the ground contact to the ground, the first signal contact to the first signal line and the second signal contact to the second signal line, comprising:

a conductor connected to the first signal contact, the conductor is biased to contact the ground contact and electrically connect the first signal contact and the ground contact;

wherein the conductor of the switch is operatively disengaged from electrical connection to the ground contact during mating of the connector, via the ground contact, the first signal contact and the second signal contact, with the ground, the first signal line and the second signal line, respectively, only after the ground contact is touching the ground, the first signal contact is touching the first signal line, and the second signal contact is touching the second signal line, and wherein the conductor of the switch is operatively engaged in electrical connection to the ground contact during de-mating of the connector, via the ground contact, the first signal contact and second signal contact, with the ground, the first signal line and the second signal line, respectively, before the ground contact is completely disengaged from touching the ground, the first signal contact is completely disengaged from touching the first signal line, and the second signal contact is completely disengaged from touching the second signal line.

6. A switch of a connector, the connector includes a ground contact and first and second differential signal contacts, the connector capable of mating with a ground and first and second differential signal lines, for electrical connection and disconnection of the ground contact to the ground, the first signal contact to the first differential signal line and the second signal contact to the second differential signal line, comprising:

a conductor connected to the first differential signal contact, the conductor is biased to contact the second differential signal contact and electrically connect the first differential signal contact and the second differential signal contact;

wherein the conductor of the switch is operatively disengaged from electrical connection to the second differential signal contact during mating of the connector, via the ground contact, the first differential signal contact and the second differential signal contact, with the ground, the first differential signal line and the second differential signal line, respectively, only after the ground contact is touching the ground, the first differential signal contact is touching the first signal line, and the second differential signal contact is touching the second signal line, and wherein the conductor of the switch is operatively engaged in electrical connection to the second differential signal line during de-mating of the connector, via the ground contact, the first differential signal contact and second differential signal contact, with the ground, the first differential signal line and the second differential signal line, respectively, before the ground contact is completely disengaged from touching the ground, the first differential signal contact is completely disengaged from touching the first signal line, and the second differential signal contact is completely disengaged from touching the second signal line.

7. A method of connecting a connector having a ground contact, a first signal contact and a second signal contact, to a ground, a first signal line and a second signal line, respectively, comprising the steps of:

connecting, substantially concurrently, the ground contact to the ground, the first signal contact to the first signal line, and the second signal contact to the second signal line; and disengaging a conductor electrically connected to the first signal contact and the ground contact from electrical connection to the ground contact, after the step of connecting.

8. A method of disconnecting a connector having a ground contact, a first signal contact and a second signal contact, from connection to a ground, a first signal line and a second signal line, respectively, comprising the steps of:

engaging a conductor connected to the first signal contact to electrically connect the ground contact and the first signal contact; and disconnecting, substantially concurrently after the step of engaging, the ground contact from the ground, the first signal contact from the first signal line, and the second signal contact from the second signal line.

9. A method of connecting a connector having a ground contact, a first differential signal contact and a second differential signal contact, to a ground, a first differential signal line and a second differential signal line, respectively, comprising the steps of:

connecting, substantially concurrently, the ground contact to the ground, the first differential signal contact to the first differential signal line, and the second differential signal contact to the second differential signal line; and disengaging a conductor electrically connected to the first differential signal and the second differential signal contact, from electrical connection to the second differential contact, after the step of connecting.

10. A method of disconnecting a connector having a ground contact, a first differential signal contact and a second differential signal contact, from connection to a ground, a first differential signal line and a second differential signal line, respectively, comprising the steps of:

engaging a conductor connected to the first signal contact to electrically connect the second differential signal contact and the first differential signal contact; and disconnecting, substantially concurrently after the step of engaging, the ground contact from the ground, the first differential signal contact from the first differential signal line, and the second differential signal contact from the second differential signal line.

11. A method of manufacture of a connector, the connector having a ground contact, a first signal contact and a second signal contact, comprising the steps of:

forming a switch in the first signal contact, the switch including a conductor biased to electrically connect the first signal contact to one of either the ground contact and instead, if the connector is for connection to differential signals, to the second signal contact;

providing the switch with an actuator operative to disconnect the conductor from electrical connection to the ground and, instead, the second signal contact, if applicable, only if the ground contact, the first signal contact and the second signal contact are electrically connected to a ground, a first signal line and a second signal line.

12. The method of claim 11, further comprising the step of:

providing the switch a deactuator operative to connect the conductor for electrical connection to the ground and, instead, the second signal contact, if applicable, before the ground contact, the first signal contact and the second signal contact are disengaged from contacting the ground, the first signal line and the second signal line on disconnection of the connector.

13. A retrofit connector, the retrofit connector capable of connecting to another connector, the other connector is one of either an XLR connector or a TRS connector, comprising:

a housing;

a pass through ground contact of the housing capable of connecting to a ground signal line and a ground contact of the other connector;

a pass through first signal contact of the housing capable of connecting to a first signal line and a first signal line of the other connector;

a pass through second signal contact of the housing capable of connecting to a second signal line of the other connector;

a switch contained in the housing, the switch operatively biased to electrically connect the pass through first signal contact to one of either the pass through ground contact and the pass through second signal contact;

wherein the switch is electrically disconnected from the either of the pass through ground contact and the pass through second signal contact, as applicable, during mating of the retrofit connector, via the pass through ground contact, the pass through first signal contact and the pass through second signal contact, with the ground contact, the first signal contact and the second signal line, respectively, of the other connector, only after the pass through ground contact is touching the ground contact, the pass through first signal contact is touching the first signal contact, and the pass through second signal contact is touching the second signal contact, and wherein the switch electrically connects the pass through first signal contact to either of the pass through ground contact and the pass through second signal contact, as applicable, during de-mating of the retrofit connector, via the pass through ground contact, the pass through first signal contact and pass through second signal contact, from connection to the ground contact, the first signal contact and the second signal contact, respectively, of the other connector, before the pass through ground contact is completely disengaged from touching the ground contact, the pass through first signal contact is completely disengaged from touching the first signal contact, and the pass through second signal contact is completely disengaged from touching the second signal contact.

* * * * *